US009010448B2

(12) United States Patent
Williamson, Jr. et al.

(10) Patent No.: US 9,010,448 B2
(45) Date of Patent: Apr. 21, 2015

(54) SAFETY VALVE WITH ELECTRICAL ACTUATOR AND TUBING PRESSURE BALANCING

(71) Applicant: Halliburton Energy Services, Inc., Houston, TX (US)

(72) Inventors: Jimmie R. Williamson, Jr., Carrollton, TX (US); Bruce E. Scott, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 24 days.

(21) Appl. No.: 13/718,951

(22) Filed: Dec. 18, 2012

(65) Prior Publication Data

US 2013/0105149 A1 May 2, 2013

Related U.S. Application Data

(63) Continuation-in-part of application No. 13/085,075, filed on Apr. 12, 2011.

(30) Foreign Application Priority Data

Dec. 21, 2011 (WO) ..... PCT/US2011/066514

(51) Int. Cl.
*E21B 43/12* (2006.01)
*E21B 34/06* (2006.01)
(Continued)

(52) U.S. Cl.
CPC ..... *E21B 34/06* (2013.01); *E21B 47/00* (2013.01); *E21B 34/066* (2013.01); *E21B 47/09* (2013.01); *E21B 2034/005* (2013.01)

(58) Field of Classification Search
CPC . E21B 34/066; E21B 2034/005; E21B 34/10; E21B 34/14; E21B 21/10; E21B 43/12; E21B 34/101; E21B 47/011; E21B 34/00
USPC ..... 166/66.6, 66.7, 334.1, 332.8, 66.4, 66
See application file for complete search history.

(56) References Cited

U.S. PATENT DOCUMENTS 2,556,435 A 6/1951 Moehrl et al.
3,866,695 A 2/1975 Jackson
(Continued)

FOREIGN PATENT DOCUMENTS

GB 2395071 A 5/2004
WO 97-30269 A1 8/1997
WO 9730269 A1 8/1997

OTHER PUBLICATIONS

Search Report issued Sep. 25, 2012 for International Application No. PCT/US11/66514, 7 pages.
(Continued)

*Primary Examiner* — Shane Bomar
*Assistant Examiner* — Kipp Wallace
(74) *Attorney, Agent, or Firm* — Smith IP Services, P.C.

(57) ABSTRACT

A well tool for use with a subterranean well can include a flow passage extending longitudinally through the well tool, an internal chamber containing a dielectric fluid, and a flow path which alternates direction, and which provides pressure communication between the internal chamber and the flow passage. A method of controlling operation of a well tool can include actuating an actuator positioned in an internal chamber of the well tool, a dielectric fluid being disposed in the chamber, and the chamber being pressure balanced with a flow passage extending longitudinally through the well tool, and varying the actuating, based on measurements made by at least one sensor of the well tool.

19 Claims, 21 Drawing Sheets

(51) Int. Cl.

| | |
|---|---|
| ***E21B 47/00*** | (2012.01) |
| ***E21B 47/09*** | (2012.01) |
| *E21B 34/00* | (2006.01) |

(56) References Cited

U.S. PATENT DOCUMENTS

| | | | | |
|---|---|---|---|---|
| 3,980,369 | A | 9/1976 | Panek | |
| 438,667 | A | 6/1983 | Millsapps, Jr. | |
| 4,453,836 | A | 6/1984 | Klima | |
| 4,537,457 | A | 8/1985 | Davis, Jr. et al. | |
| 4,598,773 | A | 7/1986 | Pringle | |
| 4,700,272 | A | 10/1987 | Bellamy | |
| 4,976,317 | A | 12/1990 | Leismer | |
| 5,027,911 | A | 7/1991 | Dysart | |
| 5,038,865 | A | 8/1991 | Taylor et al. | |
| 5,058,682 | A | 10/1991 | Pringle | |
| 5,310,004 | A | 5/1994 | Leismer | |
| 5,320,182 | A | 6/1994 | Mendez | |
| 5,441,120 | A | 8/1995 | Dysart | |
| 5,795,135 | A | 8/1998 | Nyilas et al. | |
| 5,918,688 | A * | 7/1999 | Evans | 175/57 |
| 5,947,206 | A | 9/1999 | McCalvin et al. | |
| 6,012,518 | A | 1/2000 | Pringle et al. | |
| 6,041,857 | A * | 3/2000 | Carmody et al. | 166/66.4 |
| 6,059,539 | A | 5/2000 | Nyilas et al. | |
| 6,063,001 | A | 5/2000 | Suhling et al. | |
| 6,179,055 | B1 | 1/2001 | Sallwasser et al. | |
| 6,196,339 | B1 | 3/2001 | Portwood et al. | |
| 6,206,110 | B1 | 3/2001 | Slaughte, Jr. et al. | |
| 6,250,387 | B1 | 6/2001 | Carmichael et al. | |
| 6,269,874 | B1 | 8/2001 | Rawson et al. | |
| 6,293,346 | B1 | 9/2001 | Patel | |
| 6,310,829 | B1 | 10/2001 | Green et al. | |
| 6,364,023 | B1 * | 4/2002 | Hiron et al. | 166/373 |
| 6,367,545 | B1 | 4/2002 | Van Buskirk et al. | |
| 6,431,293 | B1 | 8/2002 | Portwood et al. | |
| 6,440,033 | B1 | 8/2002 | Suhling et al. | |
| 6,450,258 | B2 | 9/2002 | Green et al. | |
| 6,575,236 | B1 | 6/2003 | Heijnen | |
| 6,602,059 | B1 | 8/2003 | Howell et al. | |
| 6,619,388 | B2 | 9/2003 | Dietz et al. | |
| 6,688,860 | B2 | 2/2004 | Du et al. | |
| 6,802,380 | B2 | 10/2004 | Blackman | |
| 6,978,842 | B2 | 12/2005 | Read, Jr. et al. | |
| 6,981,853 | B2 | 1/2006 | Du et al. | |
| 7,168,492 | B2 | 1/2007 | Laplante et al. | |
| 7,217,107 | B2 | 5/2007 | Du et al. | |
| 7,219,752 | B2 | 5/2007 | Wassell et al. | |
| 7,231,971 | B2 | 6/2007 | McCalvin | |
| 7,373,983 | B2 | 5/2008 | McGavern, III et al. | |
| 7,378,769 | B2 | 5/2008 | Head | |
| 7,434,626 | B2 | 10/2008 | Vick, Jr. | |
| 7,591,317 | B2 | 9/2009 | Bane et al. | |
| 7,635,029 | B2 | 12/2009 | MacDougall et al. | |
| 7,640,989 | B2 | 1/2010 | Williamson, Jr. et al. | |
| 7,673,705 | B2 | 3/2010 | Gearhart et al. | |
| 7,743,833 | B2 | 6/2010 | Cascario et al. | |
| 7,802,621 | B2 | 9/2010 | Richards et al. | |
| 7,828,056 | B2 | 11/2010 | Dybevik et al. | |
| 7,866,401 | B2 | 1/2011 | McCalvin | |
| 7,938,189 | B2 | 5/2011 | Rytlewski | |
| 8,056,637 | B2 | 11/2011 | Larnach | |
| 8,474,535 | B2 | 7/2013 | Richards et al. | |
| 2002/0074129 | A1 | 6/2002 | Moore | |
| 2002/0108747 | A1 * | 8/2002 | Dietz et al. | 166/66.7 |
| 2002/0108788 | A1 | 8/2002 | Peterson et al. | |
| 2002/0192090 | A1 | 12/2002 | Du et al. | |
| 2004/0136849 | A1 | 7/2004 | Du et al. | |
| 2006/0118304 | A1 * | 6/2006 | Ohmer | 166/301 |
| 2007/0084601 | A1 | 4/2007 | Wang et al. | |
| 2007/0158082 | A1 * | 7/2007 | Williamson | 166/386 |
| 2007/0284117 | A1 | 12/2007 | Smithson | |
| 2008/0053662 | A1 * | 3/2008 | Williamson et al. | 166/381 |
| 2010/0051260 | A1 | 3/2010 | Vick, Jr. et al. | |
| 2010/0147064 | A1 | 6/2010 | Difoggio | |
| 2011/0024111 | A1 * | 2/2011 | Moen et al. | 166/278 |
| 2012/0103619 | A1 * | 5/2012 | Schroeder et al. | 166/332.2 |
| 2012/0261139 | A1 | 10/2012 | Williamson, Jr. | |

OTHER PUBLICATIONS

Written Opinion issued Sep. 25, 2012 for International Application No. PCT/US11/66514, 7 pages.

U.S. Appl. No. 14/390,422, filed Dec. 5, 2012, 40 pages.

International Search Report with Written Opinion issued Sep. 24, 2012 for PCT Patent Application No. PCT/US11/064945, 12 pages.

International Search Report with Written Opinion issued Sep. 25, 2012 for PCT Patent Application No. PCT/US11/066514, 14 pages.

International Search Report and Written Opinion issued Oct. 13, 2009, for International Patent Application Serial No. PCT/US09/055187, 6 pages.

International Preliminary Report on Patentability issued Mar. 17, 2011, for International Patent Application Serial No. PCT/US09/055187, 5 pages.

Office Action issued Feb. 18, 2010 for U.S. Appl. No. 12/204,346, 12 pages.

Office Action issued Jun. 30, 2010 for U.S. Appl. No. 12/204,346, 8 pages.

Office Action issued Sep. 19, 2013 for U.S. Appl. No. 13/085,075, 37 pages.

International Search Report with Written Opinion issued Oct. 25, 2012 for PCT Patent Application No. PCT/US12/030669, 11 pages.

Office Action issued Apr. 26, 2013 for U.S. Appl. No. 13/742,886, 13 pages.

Office Action issued Oct. 9, 2013 for U.S. Appl. No. 13/742,886, 18 pages.

Office Action issued Aug. 13, 2013 for U.S. Appl. No. 13/705,658, 26 pages.

Office Action issued Feb. 5, 2014 for U.S. Appl. No. 13/705,658, 23 pages.

Office Action issued Apr. 23, 2014 for U.S. Appl. No. 13/085,075, 9 pages.

Office Action issued Nov. 20, 2014 for U.S. Appl. No. 13/742,886, 18 pages.

* cited by examiner

SAFETY VALVE WITH ELECTRICAL ACTUATOR AND TUBING PRESSURE BALANCING

CROSS-REFERENCE TO RELATED APPLICATIONS

This application claims the benefit under 35 USC §119 of the filing date of International Application Serial No. PCT/US11/66514 filed 21 Dec. 2011, and is a continuation-in-part of U.S. application Ser. No. 13/085,075 filed 12 Apr. 2011. The entire disclosures of these prior applications are incorporated herein by this reference.

BACKGROUND

This disclosure relates generally to equipment utilized and operations performed in conjunction with a subterranean well and, in one example described below, more particularly provides a safety valve with an electrical actuator and tubing pressure balancing.

Actuators are used in various types of well tools. Unfortunately, fluids in wells can damage or impair operation of some well tool actuators. Therefore, it will be appreciated that improvements are continually needed in the arts of isolating well tool actuators from well fluids, and actuating well tools.

SUMMARY

In this disclosure, systems and methods are provided which bring improvements to the arts of isolating well tool actuators from well fluids, and actuating well tools. One example is described below in which an actuator is exposed to a dielectric fluid isolated from an interior flow passage. Another example is described below in which various sensors can be used to control actuation of the well tool.

In one aspect, this disclosure provides to the art a well tool for use with a subterranean well. In one example, the well tool can include a flow passage extending longitudinally through the well tool, an internal chamber containing a dielectric fluid, and a flow path which alternates direction. The flow path provides pressure communication between the internal chamber and the flow passage.

In another aspect, a method of controlling operation of a well tool can include actuating an actuator positioned in an internal chamber of the well tool, a dielectric fluid being disposed in the chamber, and the chamber being pressure balanced with a flow passage extending longitudinally through the well tool; and varying the actuating, based on measurements made by at least one sensor of the well tool.

In yet another aspect, a safety valve for use in a subterranean well is described below. In one example, the safety valve can include a flow passage extending longitudinally through the safety valve, an internal chamber containing a dielectric fluid, a flow path which alternates direction, and which provides pressure communication between the internal chamber and the flow passage, an actuator exposed to the dielectric fluid, an operating member, and a closure member having open and closed positions, in which the closure member respectively permits and prevents flow through the flow passage. The actuator displaces the operating member, which causes displacement of the closure member between its open and closed positions.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
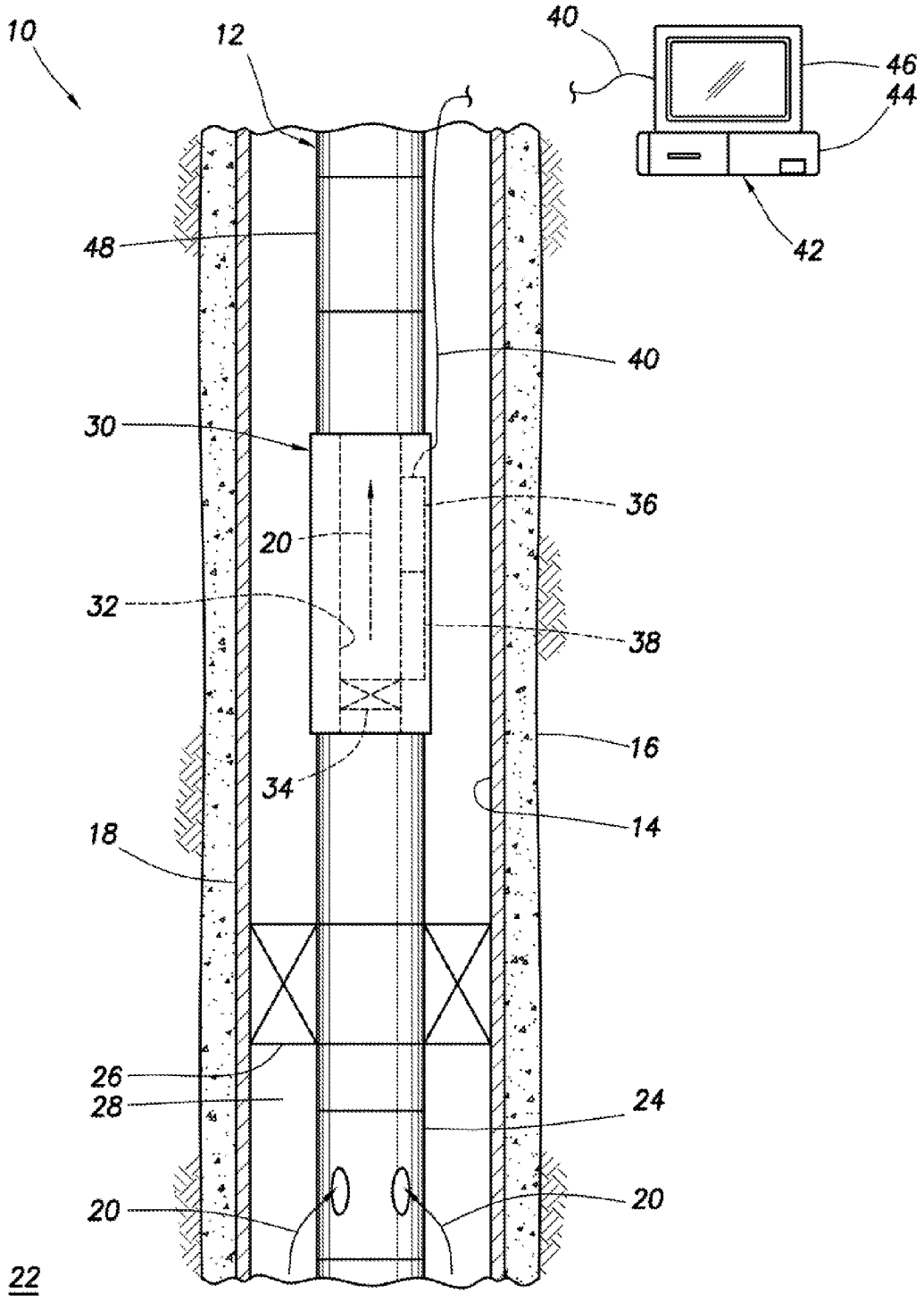
FIG. 1 is a representative partially cross-sectional view of a well system and associated method which can embody principles of this disclosure.

Representatively illustrated in FIG. 1 is a system 10 and associated method which can embody principles of this disclosure. However, the system 10 and method comprise only one example of how the principles of this disclosure can be applied in practice, and so it should be clearly understood that those principles are not limited to any of the specific details of the system 10 and method described herein or depicted in the drawings.

In the FIG. 1 example, a tubular string 12 is installed in a wellbore 14 lined with casing 18 and cement 16. Well fluid 20 (in this case, produced from an earth formation 22 penetrated by the wellbore 14) enters the tubular string 12 via a flow control device 24 (such as, a sliding sleeve valve, a variable choke, etc.). A packer 26 seals off an annulus 28 formed radially between the tubular string 12 and the wellbore 14.

A well tool 30 selectively permits and prevents flow of the fluid 20 through a longitudinal flow passage 32 formed through the well tool and the substantial remainder of the tubular string 12. In this example, the well tool 30 comprises a safety valve. However, in other examples, the well tool 30 could comprise a flow control device (such as the flow control device 24) or another type of well tool (such as the packer 26, a chemical injection tool, a separator, etc.).

The well tool 30 depicted in FIG. 1 includes a closure member 34, an electronic circuit 36 and an actuator 38. The actuator 38 is used to displace the closure member 34 to and between open and closed positions in which flow of the fluid 20 is respectively permitted and prevented.

The closure member 34 in one example described below comprises a flapper which pivots relative to the flow passage 32 between the open and closed positions. In other examples, the closure member 34 could instead be a ball, gate, sleeve, or other type of closure member. Multiple closure members or multi-piece closure members could be used, if desired.

The electronic circuit 36 in the example described below comprises a hybridized circuit, in which semiconductor dies are mounted to a circuit board with little or no packaging surrounding the dies. This significantly reduces a volume requirement of the electronic circuit 36, allowing a wall thickness of the well tool 30 to be reduced. However, other types of electronic circuits may be used, if desired.

The actuator 38 in the example described below comprises an electrical actuator, such as a direct current stepper motor. One advantage of such a motor is that a torque and/or force output of the motor can be conveniently regulated, and a position of an operating member displaced by the actuator 38 can be conveniently determined by monitoring a number of step pulses transmitted to the motor. However, other types of electrical actuators, and other types of actuators, may be used in keeping with the scope of this disclosure.

One or more lines 40 extend from the well tool 30 to a remote location (such as the earth's surface, a rig, a subsea location, etc.). The lines 40 can include one or more electrical conductors for conveying electrical power to the electronic circuit 36, transmitting commands, data, etc. to the well tool 30, receiving data, etc. from the well tool, etc. The lines 40 may include optical waveguides (such as optical fibers, ribbons, etc.), hydraulic conduits, and/or other types of lines, if desired.

In the example described below, the lines 40 extend internally through a conduit (for example, a conduit of the type known to those skilled in the art as a control line). The conduit protects the lines 40 during installation of the tubular string 12 in the wellbore 14, and thereafter. However, use of the conduit is not necessary in keeping with the principles of this disclosure.

A control system 42 is located at the remote location, and is connected to the lines 40. The control system 42 may include a computing device 44 and a display 46, along with suitable memory, software, firmware, connectivity (e.g., to the Internet, to a satellite, to a telephony line, etc.), processor(s), etc., to communicate with and control operation of the well tool 30. Alternatively, the control system 42 could be as simple as a switch to either apply electrical power, or not apply electrical power, to the well tool 30.

An optional telemetry device 48 is included in the system 10 for relaying commands, data, etc. between the well tool 30 and the control system 42 at the remote location. For example, acoustic, electromagnetic, pressure pulse, a combination of short- and long-hop transmissions, or any other type of telemetry may be used. Wired or wireless telemetry, or a combination, may be used.

Since the fluid 20 is produced from the formation 22 through the tubular string 12, those skilled in the art would refer to the tubular string as a production tubing string. The tubular string 12 could be jointed or continuous.

However, it should be understood that it is not necessary for the tubular string 12 to be a production tubing string, or for the fluid 20 to be produced from the formation 22 through the tubular string. In other examples, well tools incorporating the principles of this disclosure could be used in injection operations. Well tools incorporating the principles of this disclosure are not necessarily interconnected in a tubular string.

Referring additionally now to FIGS. 2A-10, a representative example of the well tool 30 is depicted in various longitudinal and lateral cross-sectional views. The well tool 30 of FIGS. 2A-10 may be used in the system 10 and method of FIG. 1, or the well tool may be used in other system and methods.

Figure 4:
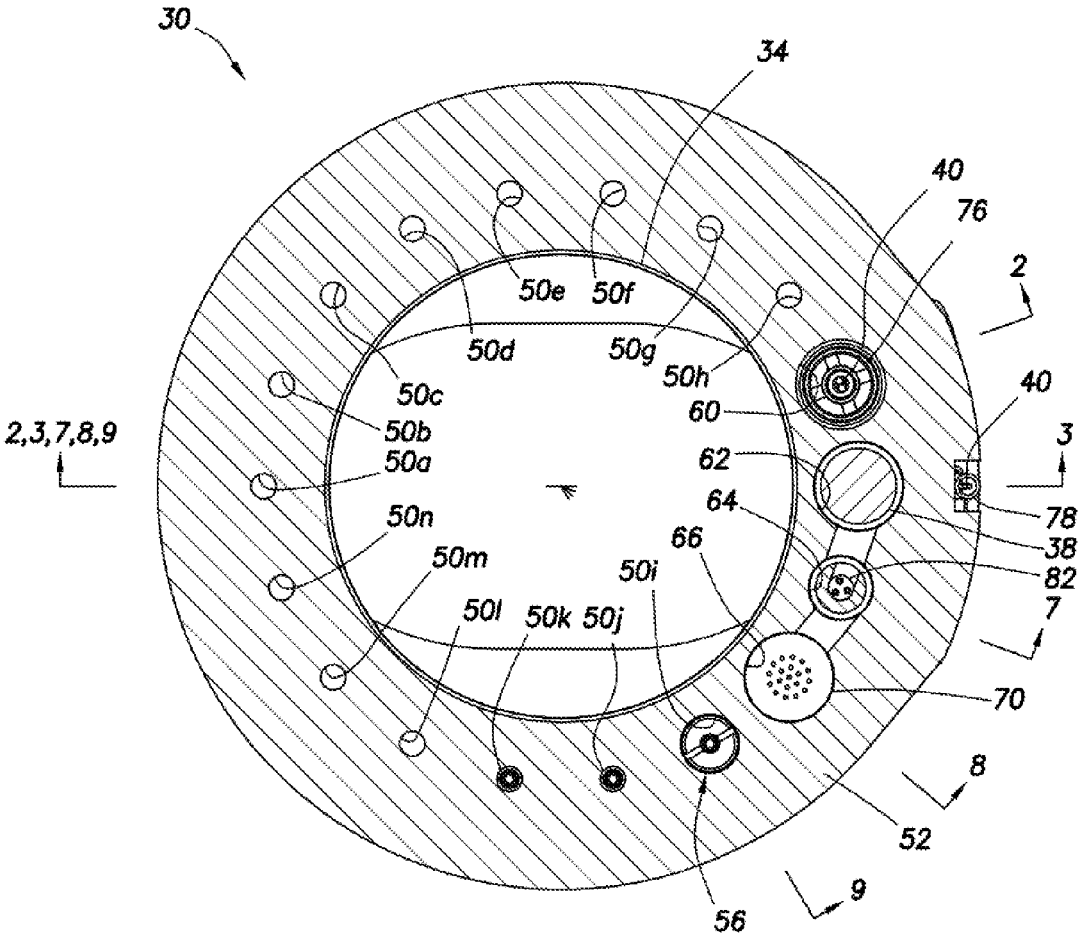
FIG. 4 is a representative lateral cross-sectional view of the well tool, taken along line 4-4 of FIG. 2A.

In FIGS. 2A-D, a longitudinal cross-sectional view, taken along lines 2-2 of FIG. 4 is representatively illustrated. In this view, it may be seen that the well tool 30 includes a generally longitudinally extending flow path 50.

One section 50*a* of the flow path 50 is visible in FIGS. 2A-D. However, in this example, there are actually fourteen of the sections 50*a-n* (see FIG. 4) spaced apart circumferentially in a side wall 52 of the tool 30.

Of course, any number and/or arrangement of flow path sections may be used in other examples incorporating the principles of this disclosure. For example, the flow path sections 50*a-n* could be helically and/or laterally arranged.

In the FIGS. 2A-10 example, the sections 50*a-n* are arranged so that they alternate direction when viewed as a continuous flow path 50. The flow path 50 provides pressure communication between the flow passage 32 extending through the tubular string 12 and an internal generally longitudinally extending chamber 62 (see FIG. 4).

The actuator 38 is positioned in the chamber 62. A dielectric fluid 54 (e.g., a silicone fluid, etc.) surrounds the actuator 38 in the chamber 62. The fluid 54 also fills a substantial majority of the flow path 50.

A floating piston assembly 56 (see FIGS. 9A & 10) isolates the dielectric fluid 54 from the well fluid 20, which enters the flow path 50 via an opening 58. The assembly 56 permits pressure to be balanced (e.g., at substantially equal levels) between the flow passage 32 and the chamber 62 via the flow path 50, without any mixing of the fluids 20, 54.

In this manner, the chamber 62 is isolated from the well fluid 20 (which could interfere with operation of the actuator 38, electronic circuit 36, etc.), but the side wall 52 does not have to withstand a large pressure differential between the chamber 62 and the flow passage 32. Thus, the side wall 52 can be made thinner, due to the chamber 62 being pressure balanced with the flow passage 32.

Note that the floating piston assembly 56 is reciprocably and sealingly received in a radially enlarged section 50*i* of the flow path 50. This allows the floating piston assembly 56 to displace more volume per unit of translational displacement, thereby allowing more expansion of the dielectric fluid 54 with increased temperature, and allowing for a greater range of pressure transmission (although, if the dielectric fluid 54 is substantially incompressible, very little volume change would be expected due to pressure in a typical downhole environment). A pressure relief valve or other pressure relief device 68 is provided in the floating piston assembly 56 to relieve excess pressure in the flow path 50 due, for example, to increased temperature.

The chamber 62 is one of several chambers 60, 62, 64, 66 in fluid communication with the flow path 50. The electronic circuit 36 is positioned in the chamber 66 (see FIGS. 8A & B).

A generally tubular housing 70 forms an enclosure 72 in which the electronic circuit 36 is contained, isolated from the fluid 54 in the chamber 66. The housing 70 in this example comprises a pressure bearing weldment. However, if the electronic circuit 36 can withstand the pressure in the chamber 66 (substantially the same as the pressure in the flow passage 32), then the housing 70 may not be used, or at least the housing may not have to withstand as much differential pressure.

Figure 5:
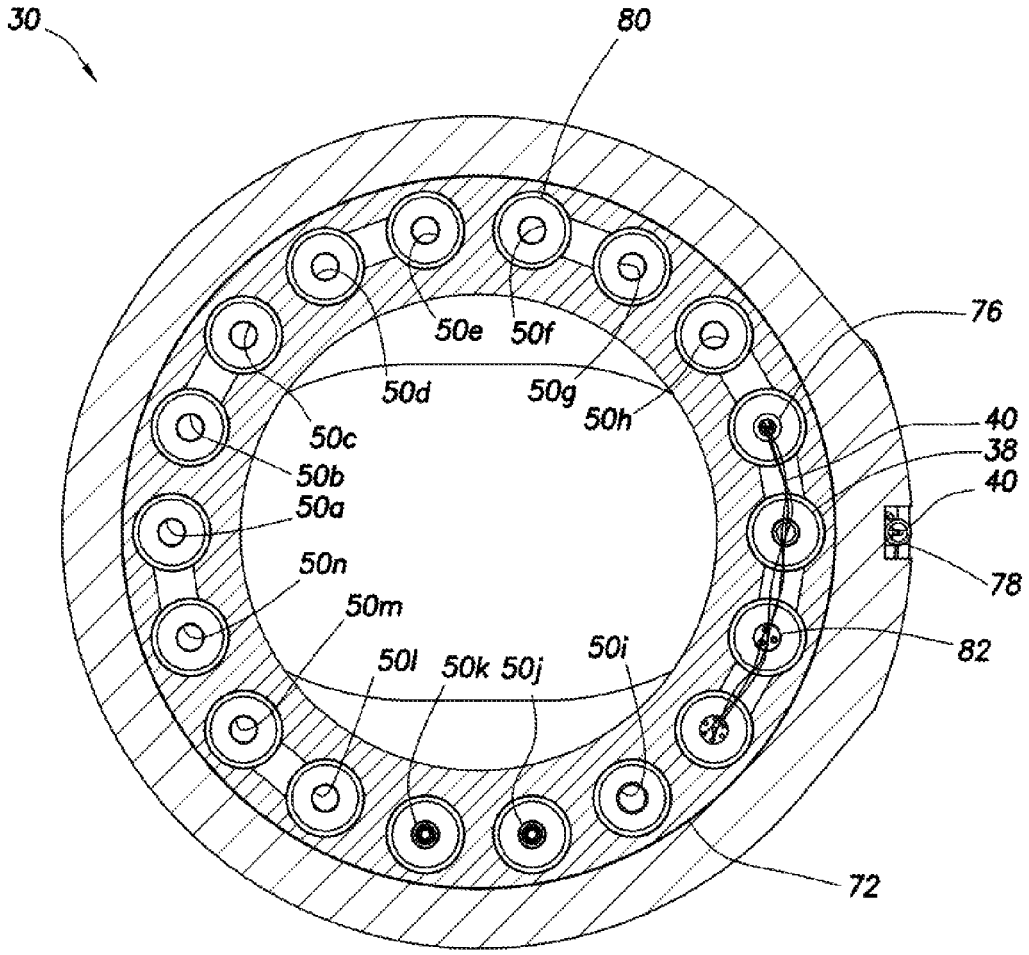
FIG. 5 is a representative lateral cross-sectional view of the well tool, taken along line 5-5 of FIG. 3A.
Figure 6:
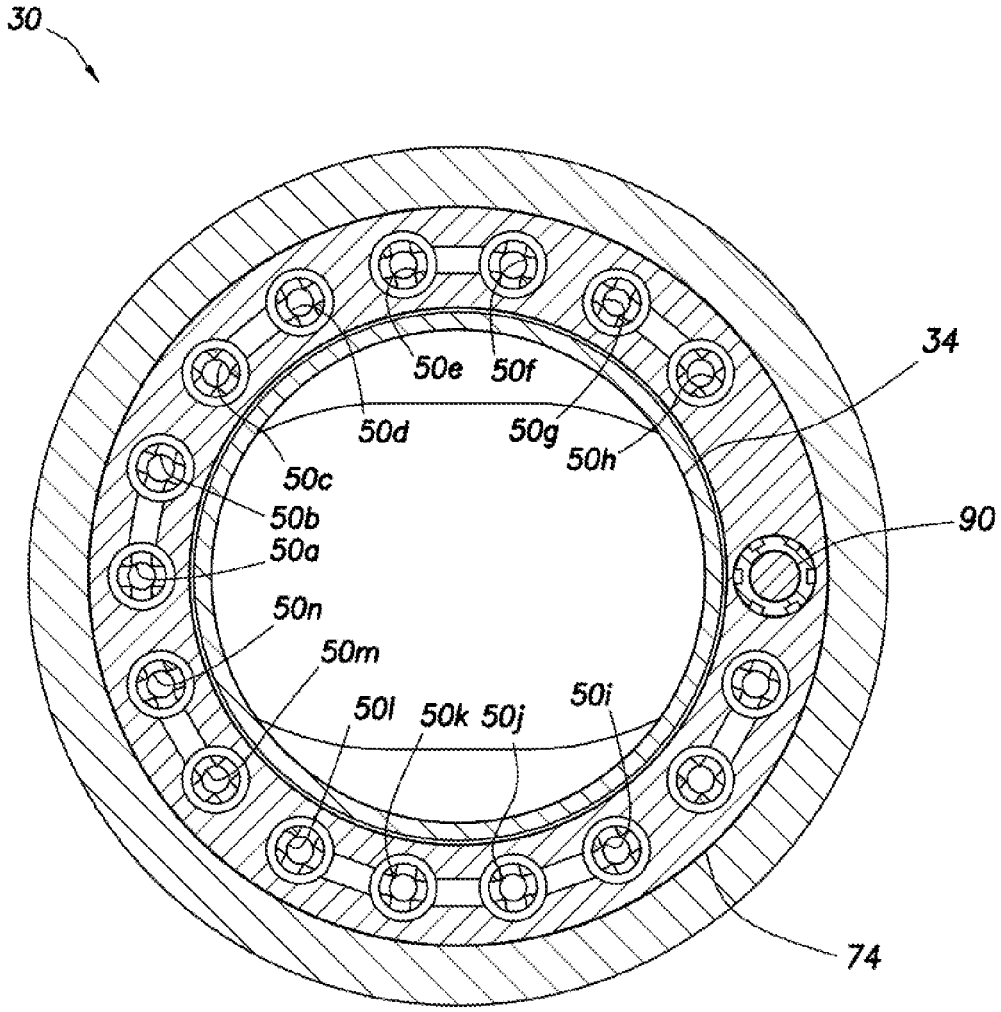
FIG. 6 is a representative lateral cross-sectional view of the well tool, taken along line 6-6 of FIG. 3C.
Figure 7A:
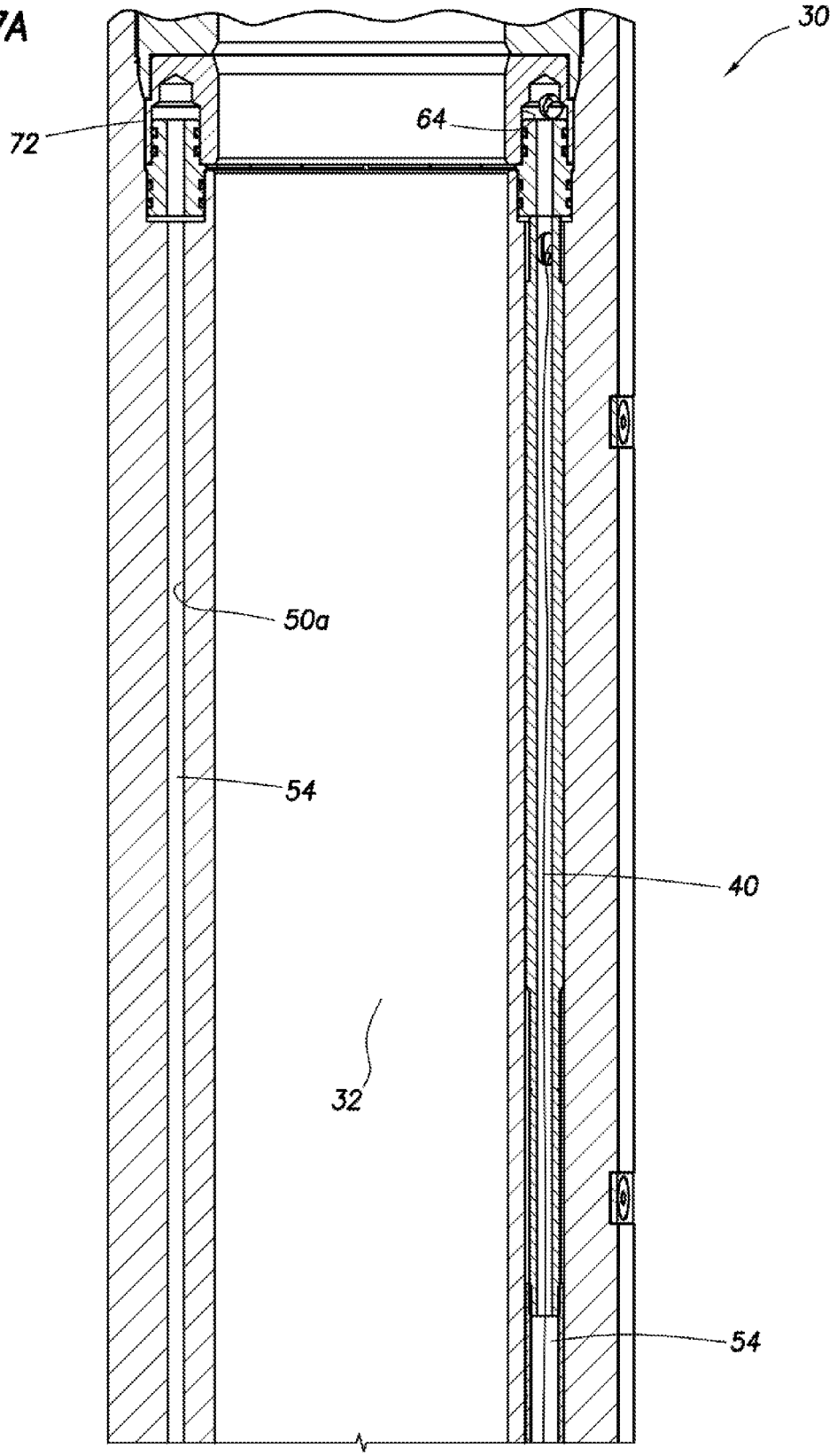
FIGS. 7A-9B are further representative cross-sectional views of the well tool.
Figure 7B:
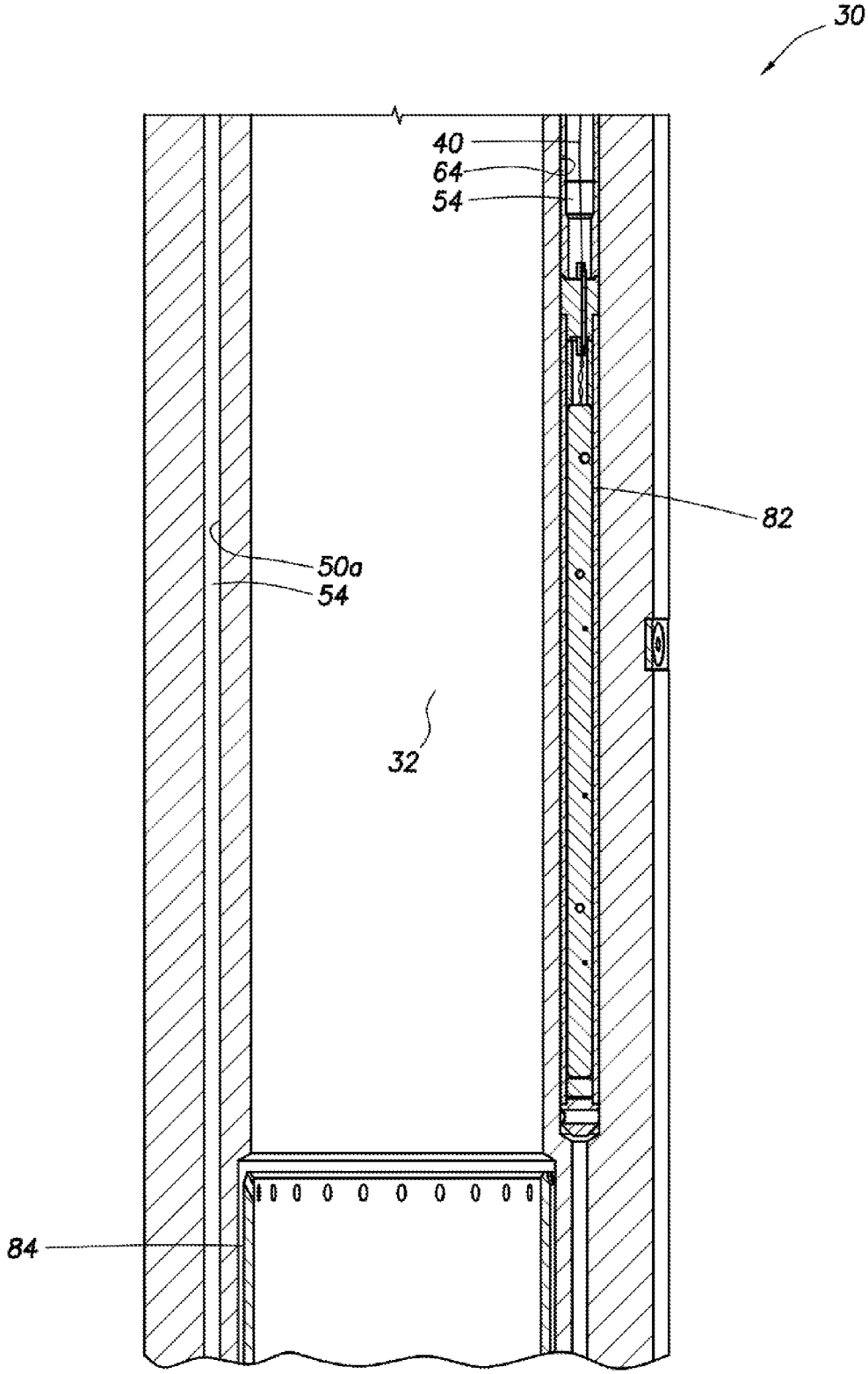
Figure 8A:
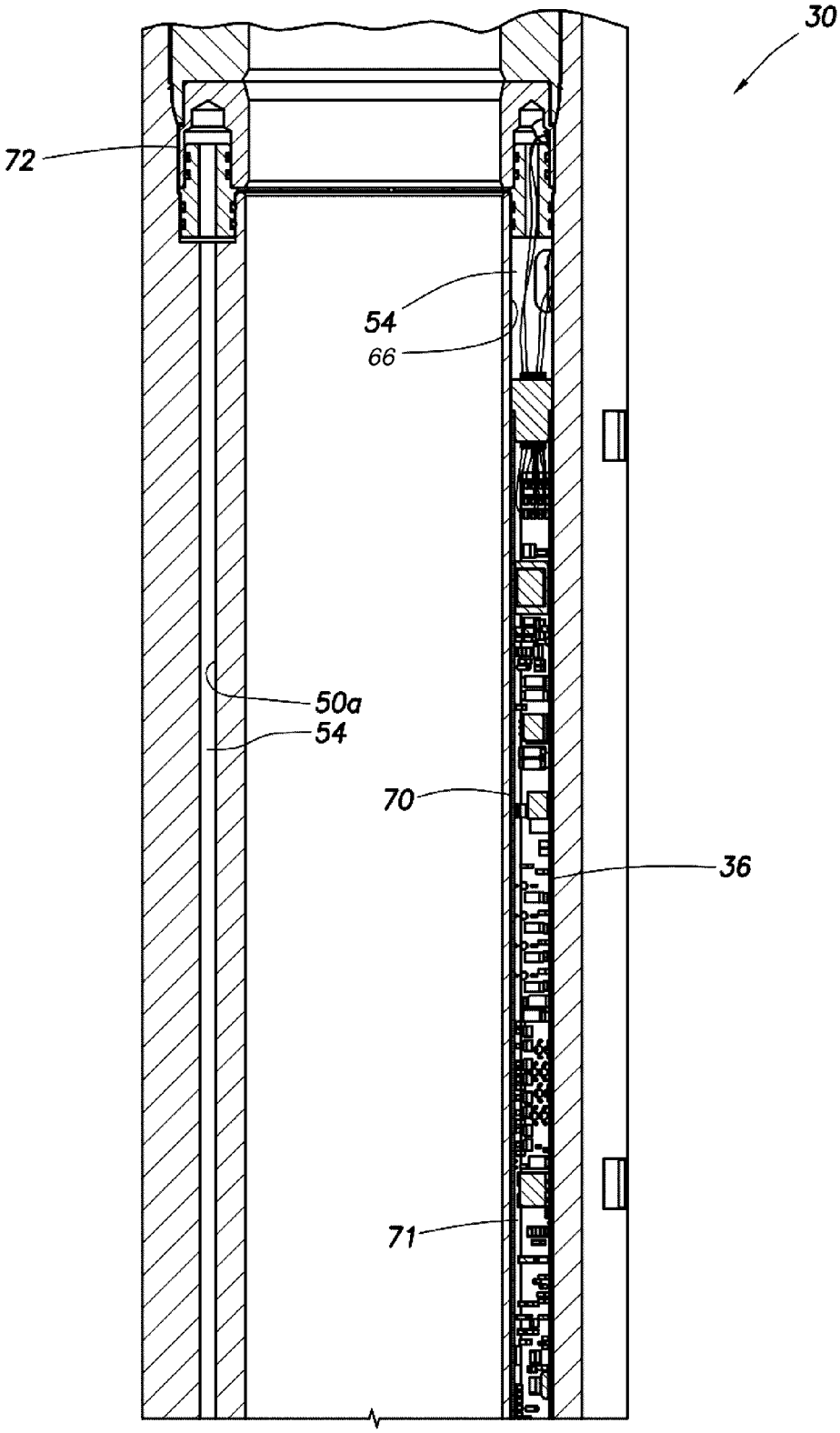
Figure 8B:
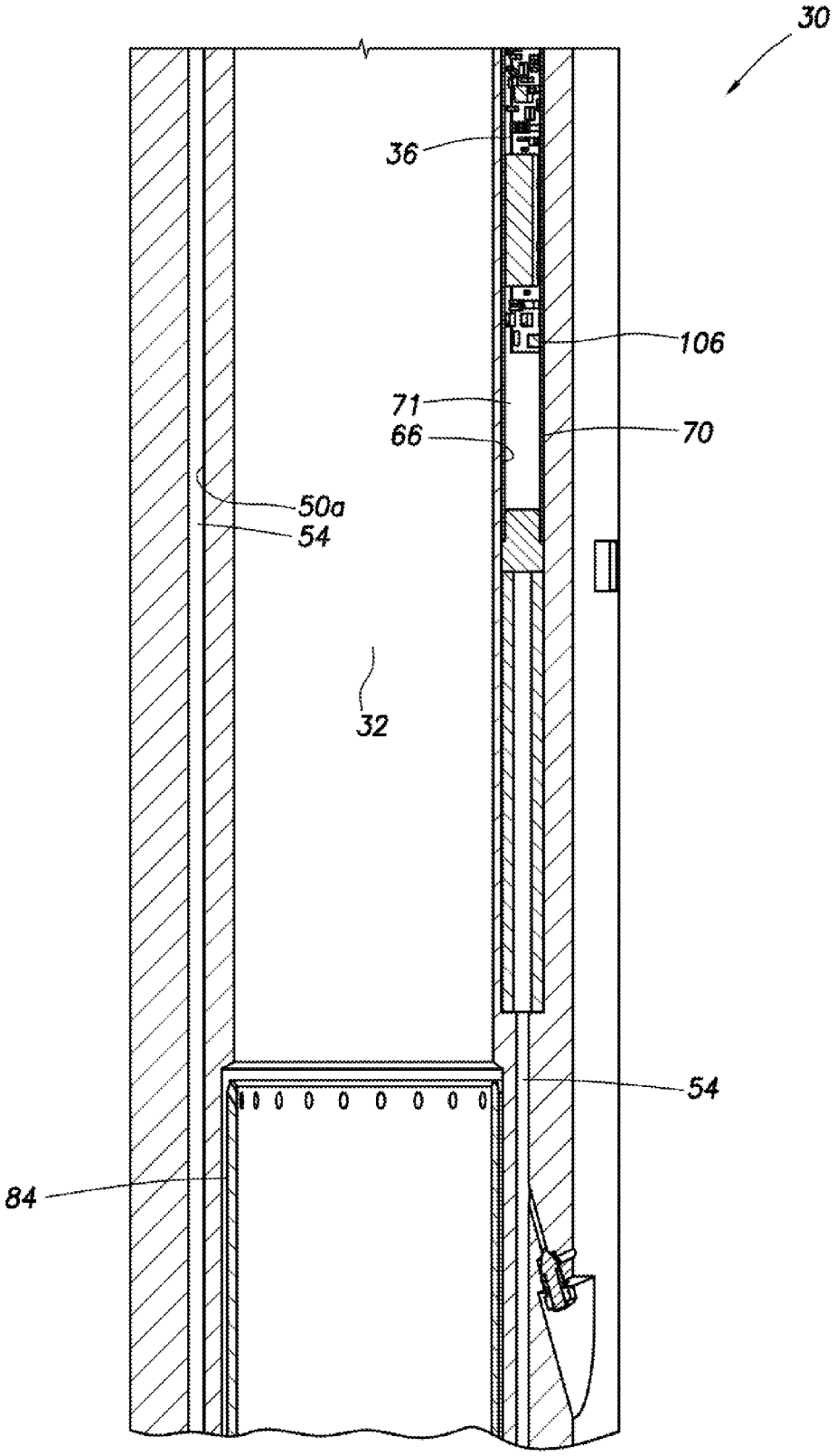
Figure 9A:
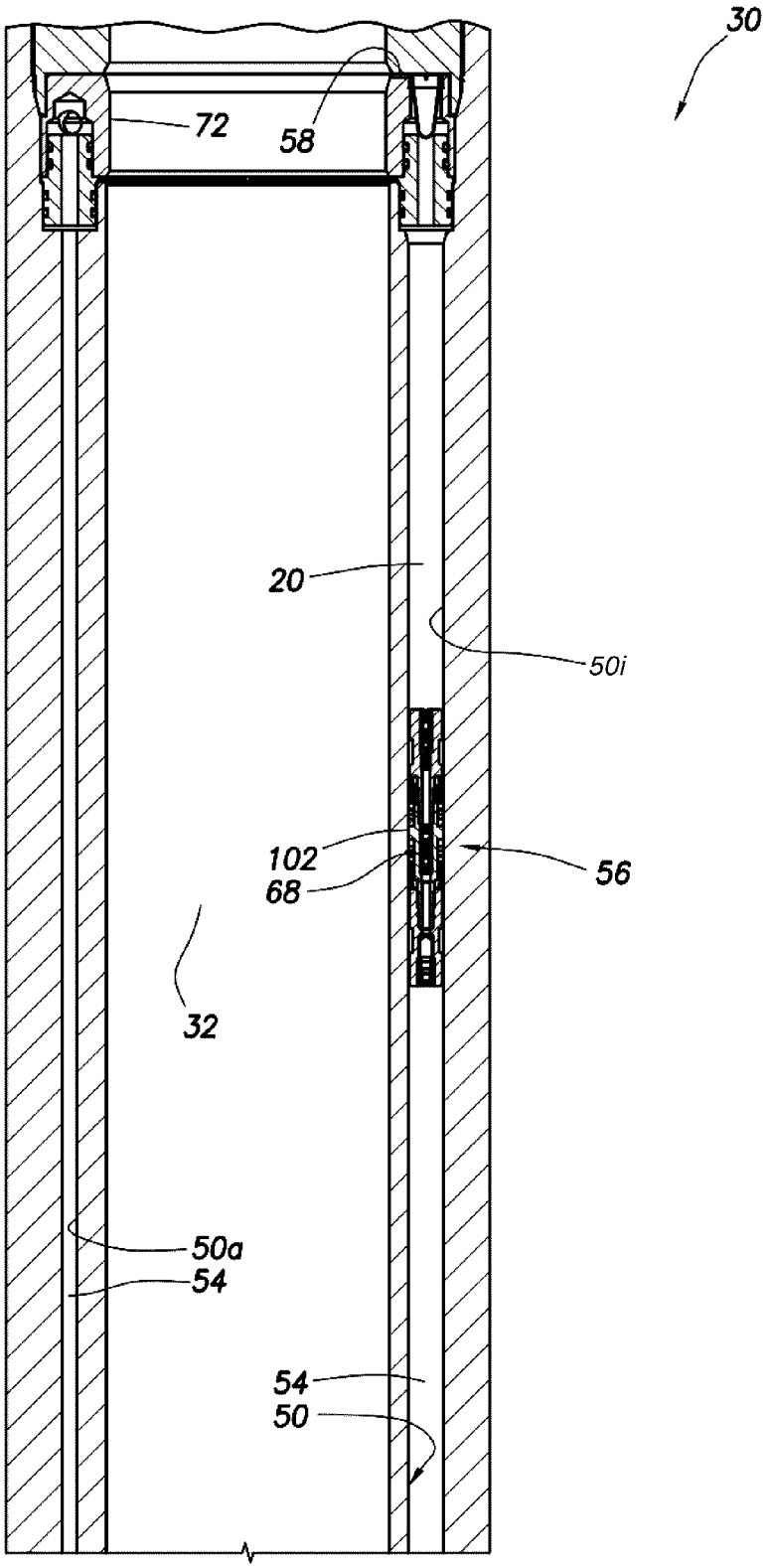
Figure 9B:
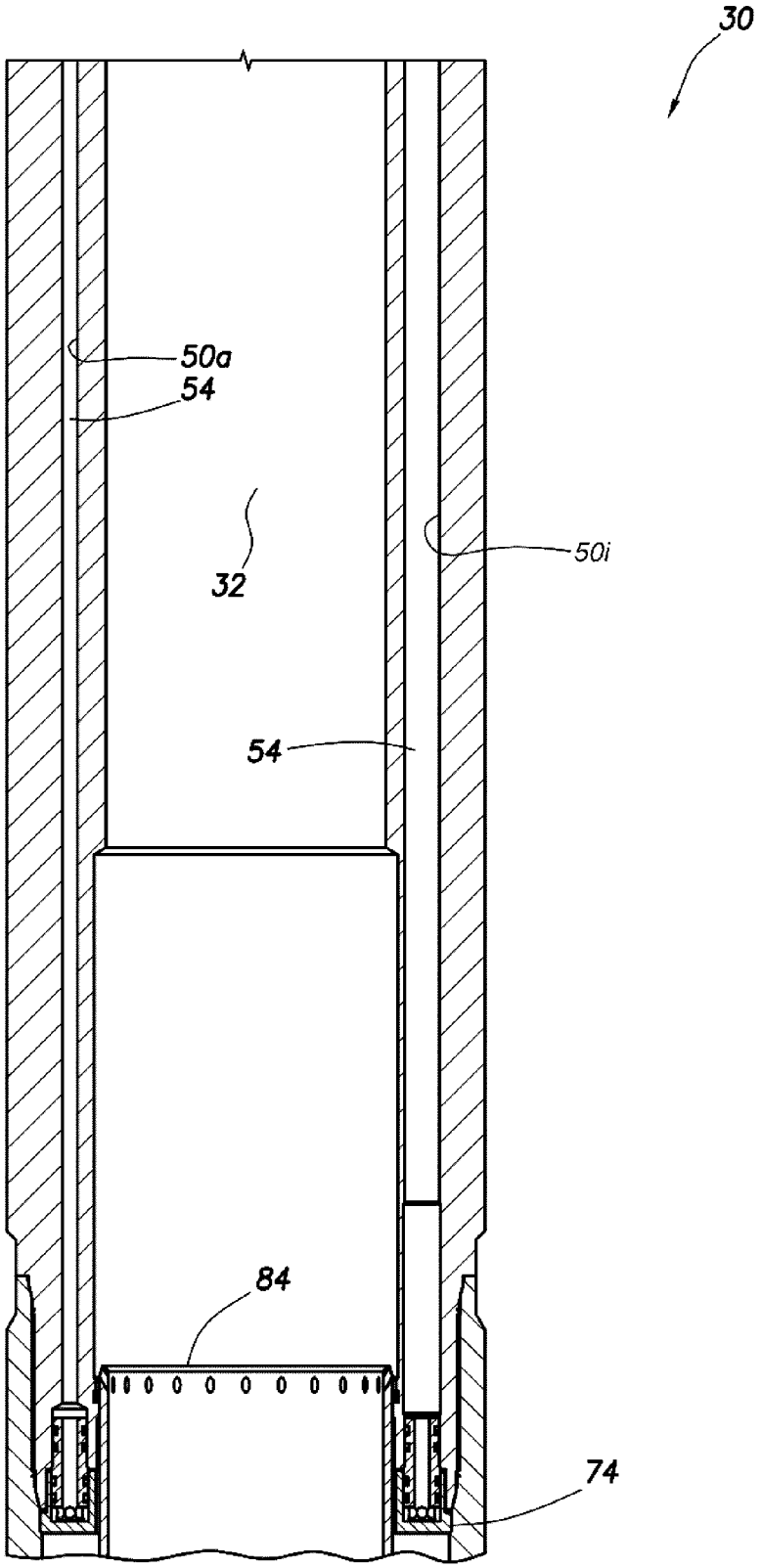
Figure 10:
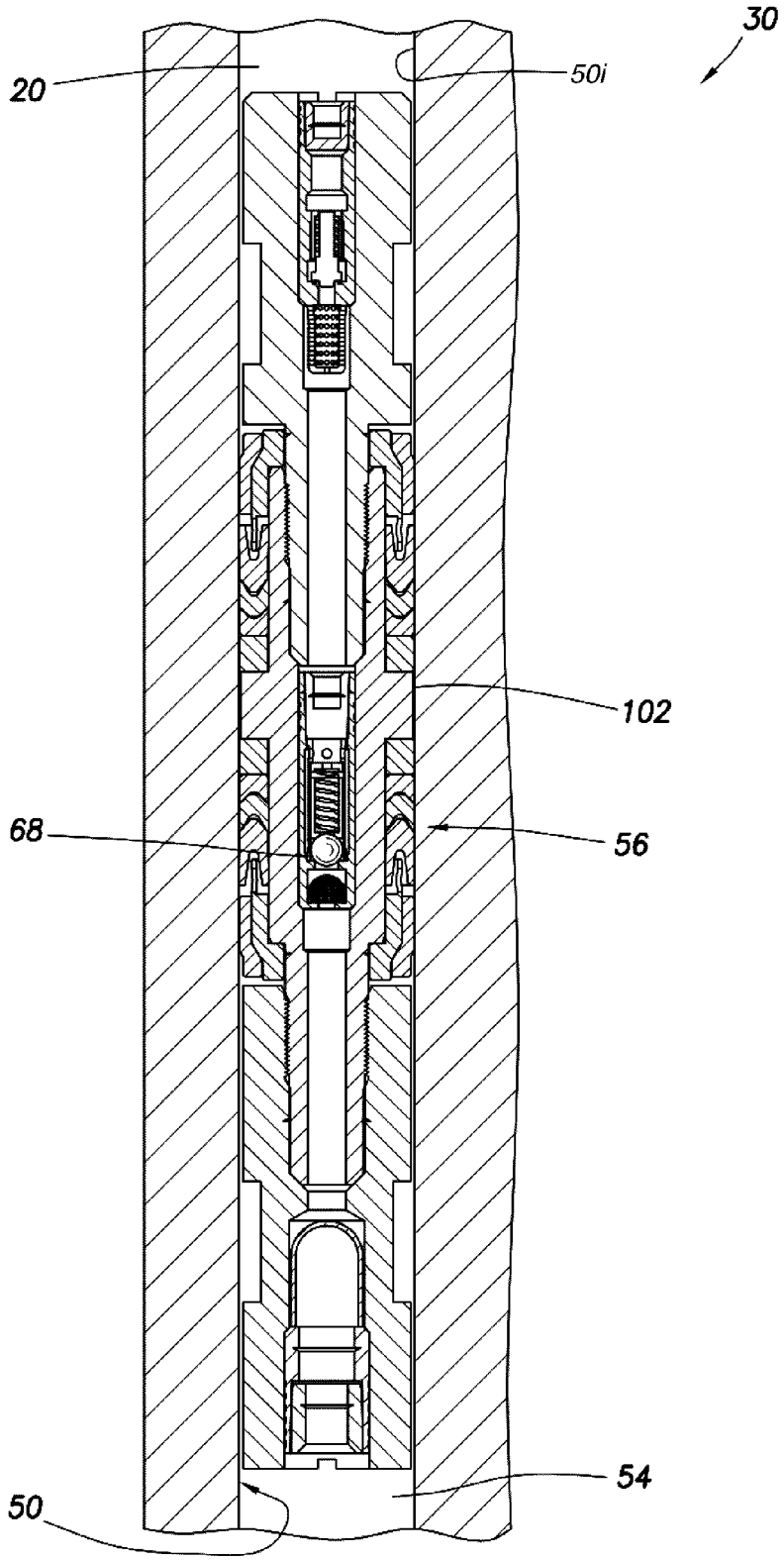
FIG. 10 is an enlarged scale representative cross-sectional view of a floating piston assembly of the well tool.

Upper and lower manifolds 72, 74 provide fluid communication between the flow path sections 50*a-o* and chambers 60, 62, 64, 66. FIG. 5 depicts a lateral cross-sectional view of the upper manifold 72, and FIG. 6 depicts a lateral cross-sectional view of the lower manifold 74, taken along lines 5-5 and 6-6 of FIGS. 3A & C, respectively.

Alternating opposite ends of adjacent ones of the flow path sections 50*a-n* are placed in fluid communication with each other by the manifolds 72, 74. In addition, electrical conductors and/or optical waveguides can extend through openings in the manifolds 72, 74 (see FIG. 5).

Figure 2A:
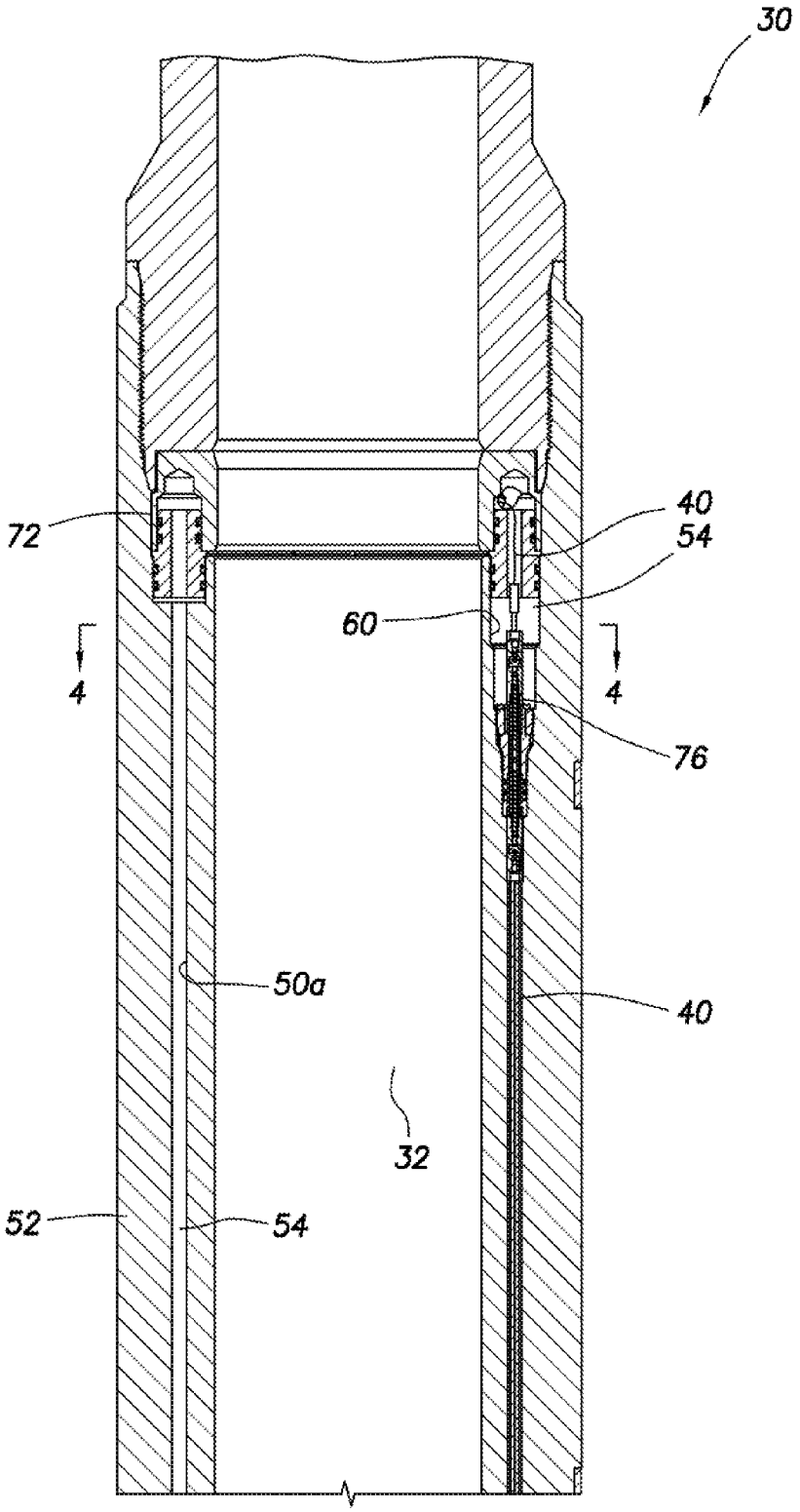
FIGS. 2A-D are enlarged scale representative longitudinal cross-sectional views of a well tool which can embody principles of this disclosure, and which may be used in the well system and method of FIG. 1
Figure 2B:
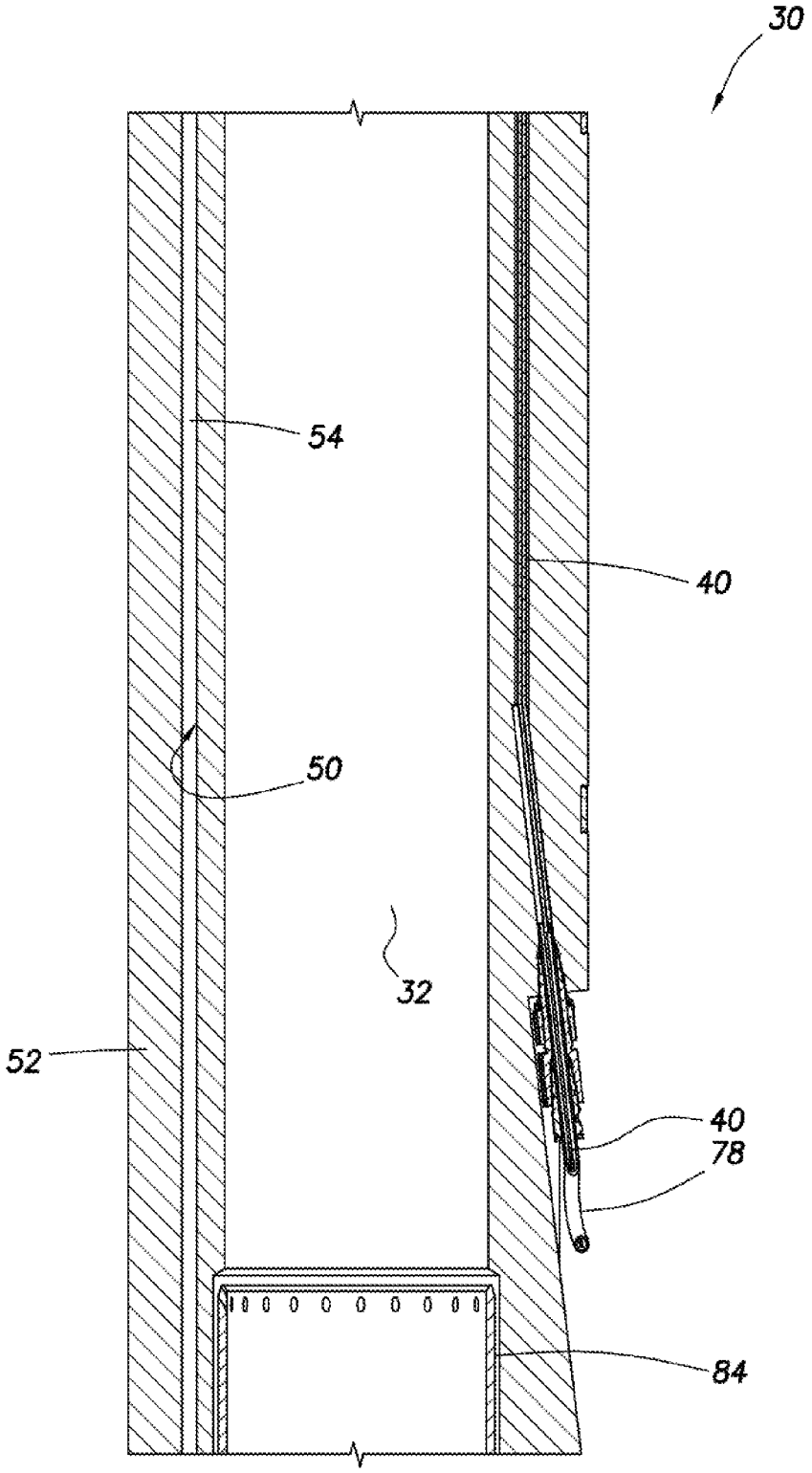
Figure 2C:
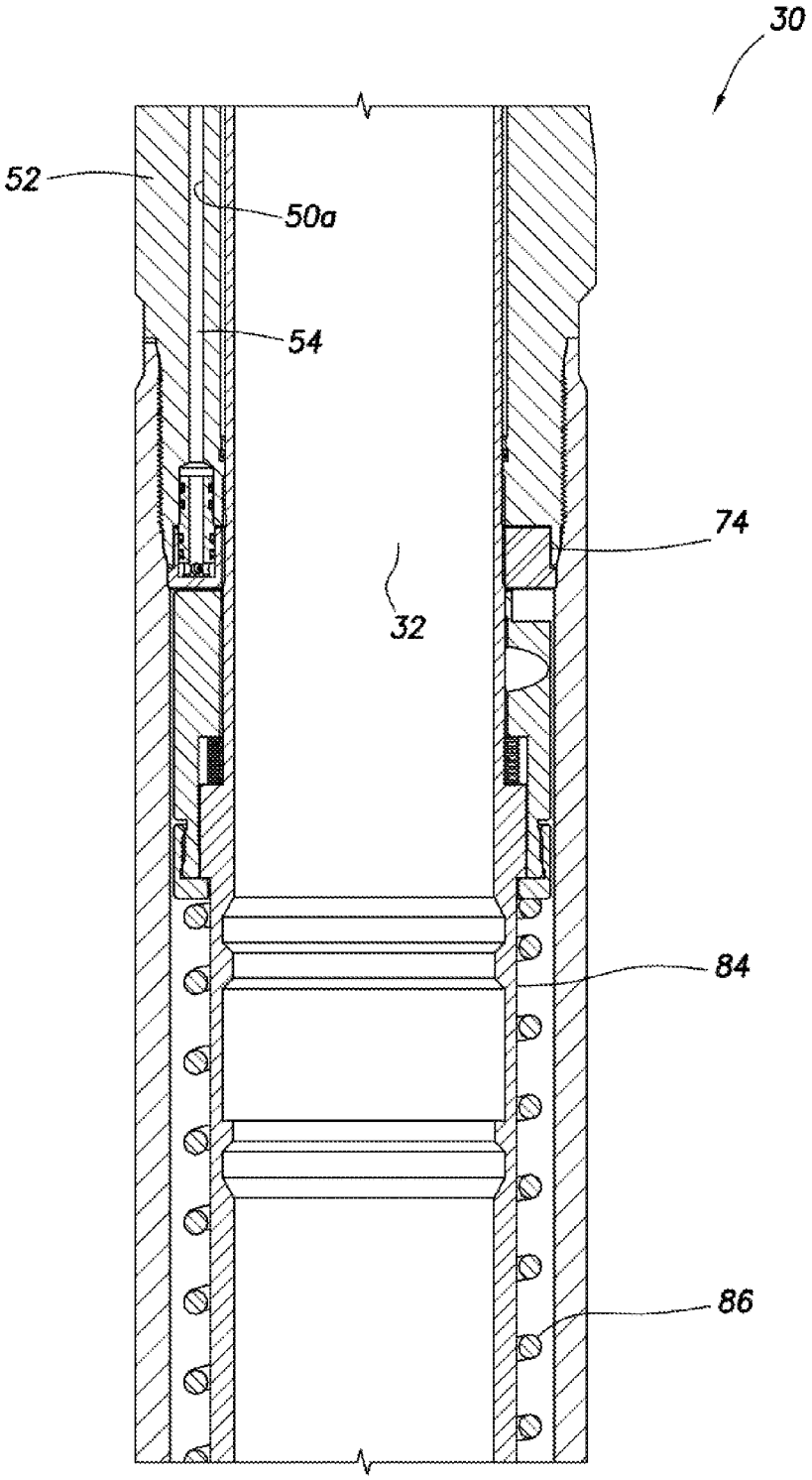
Figure 2D:
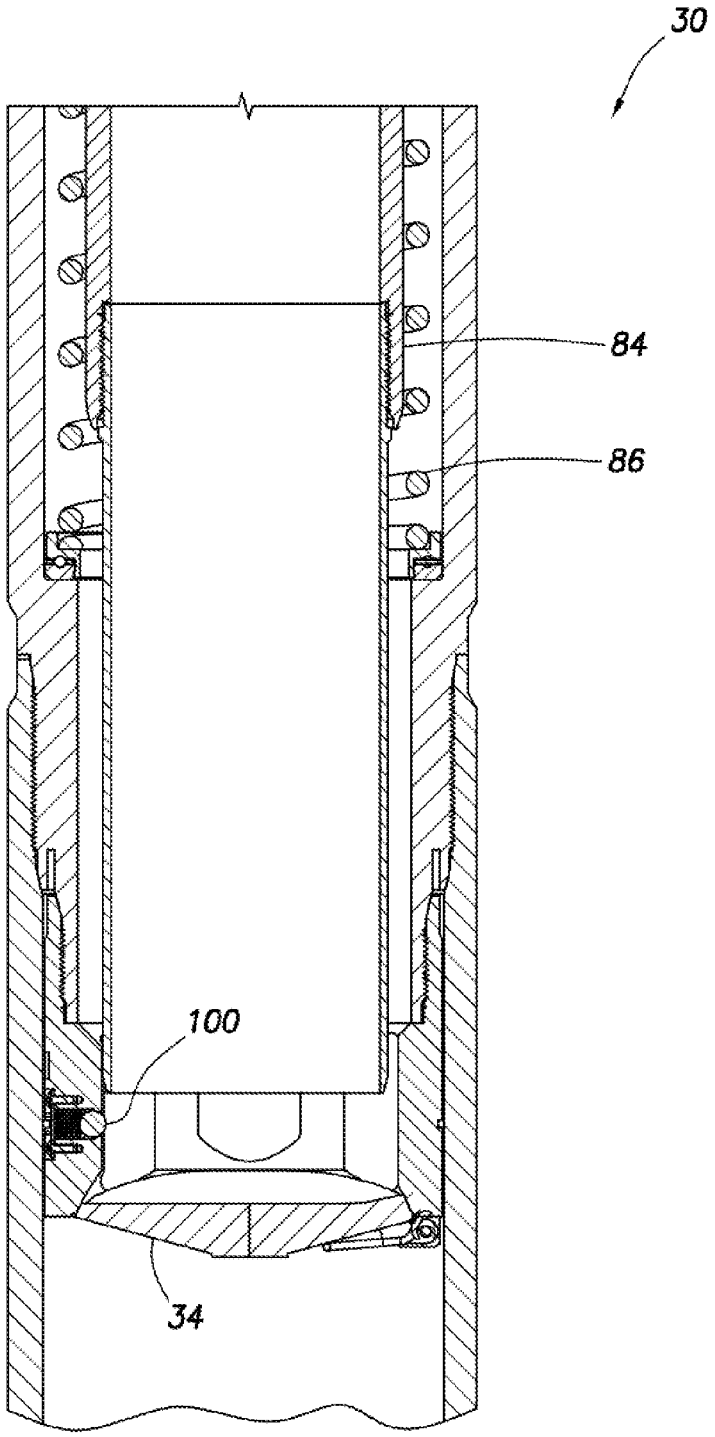
Figure 3A:
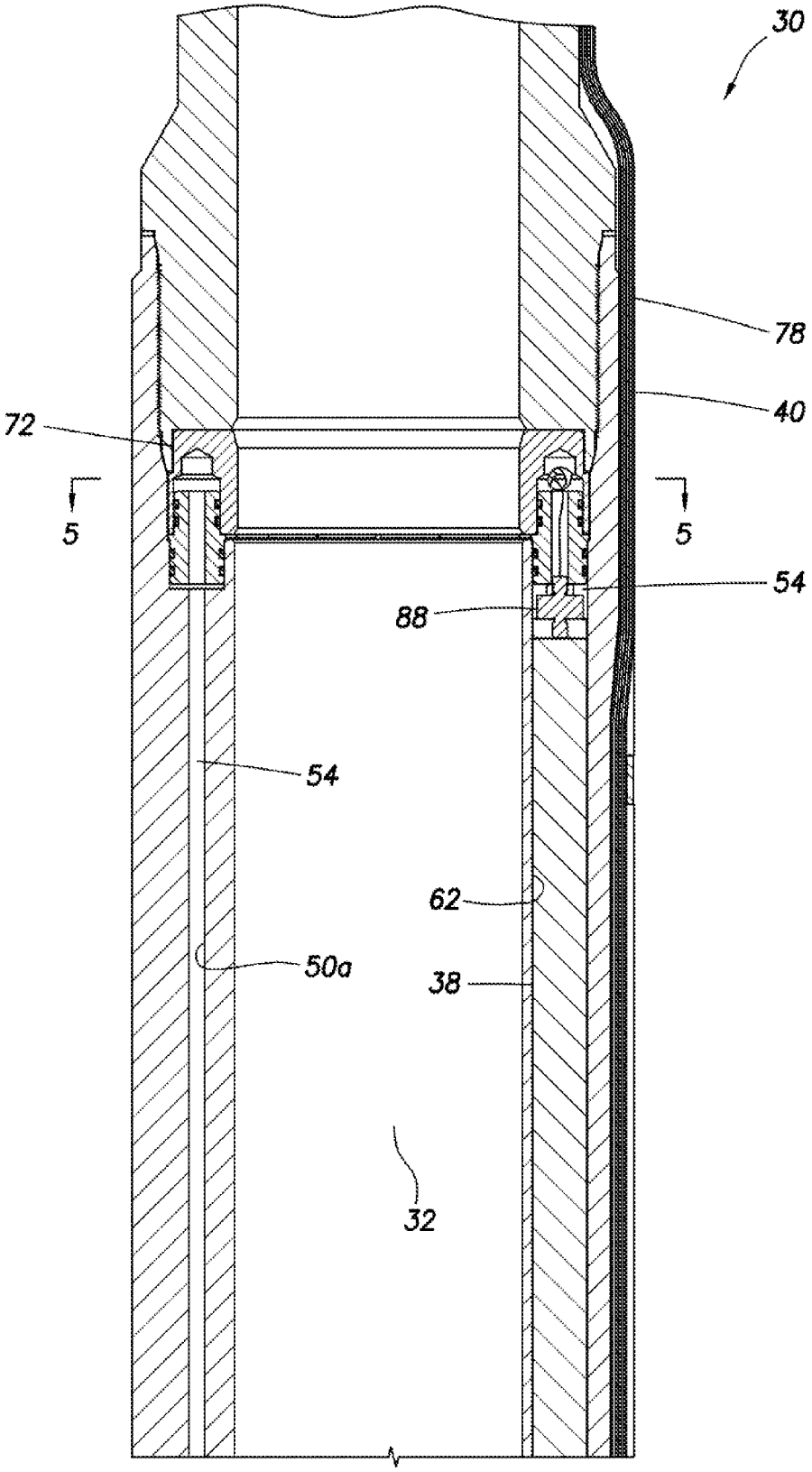
FIGS. 3A-C are representative longitudinal cross-sectional views of the well tool.
Figure 3B:
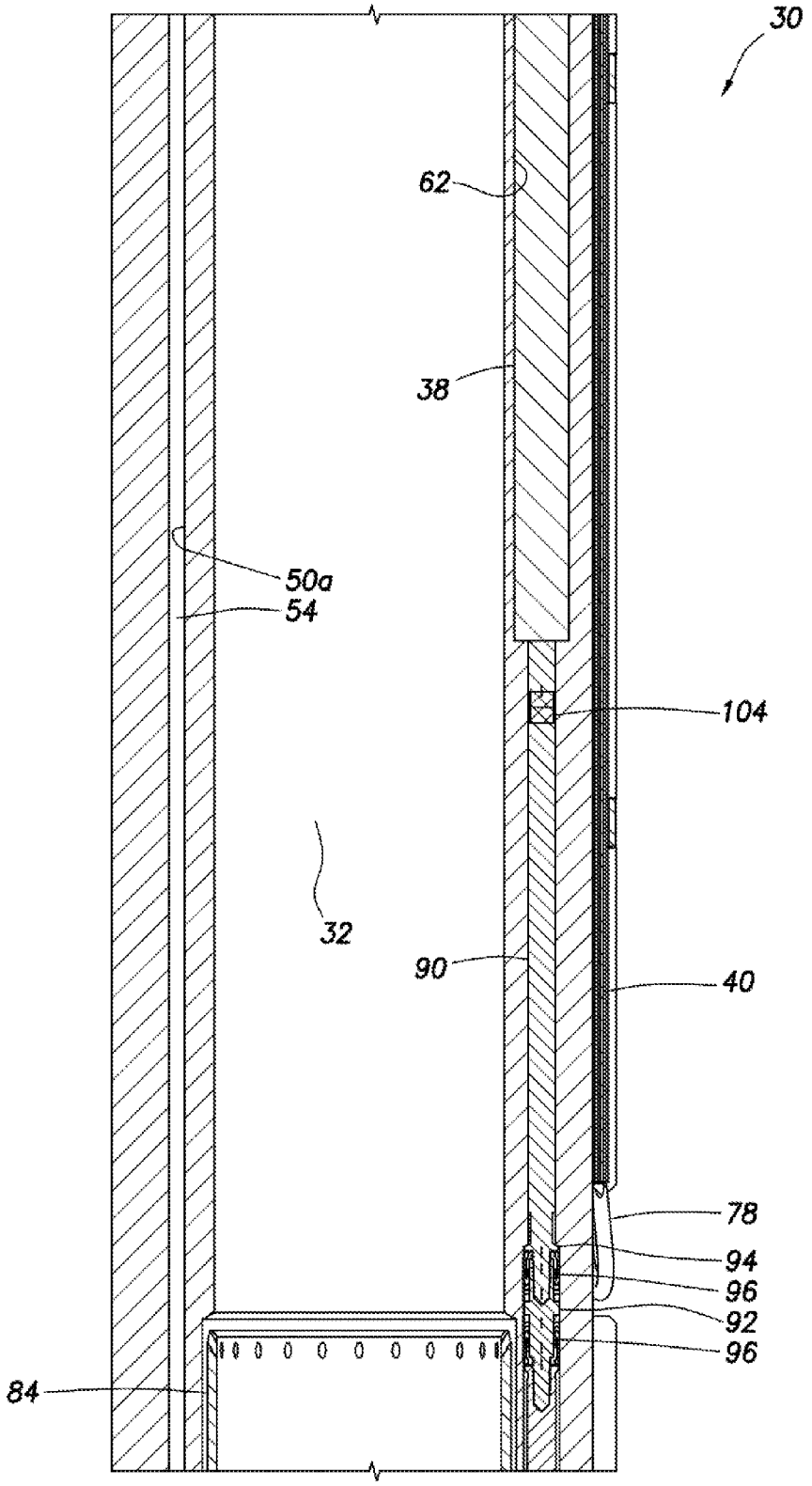
Figure 3C:
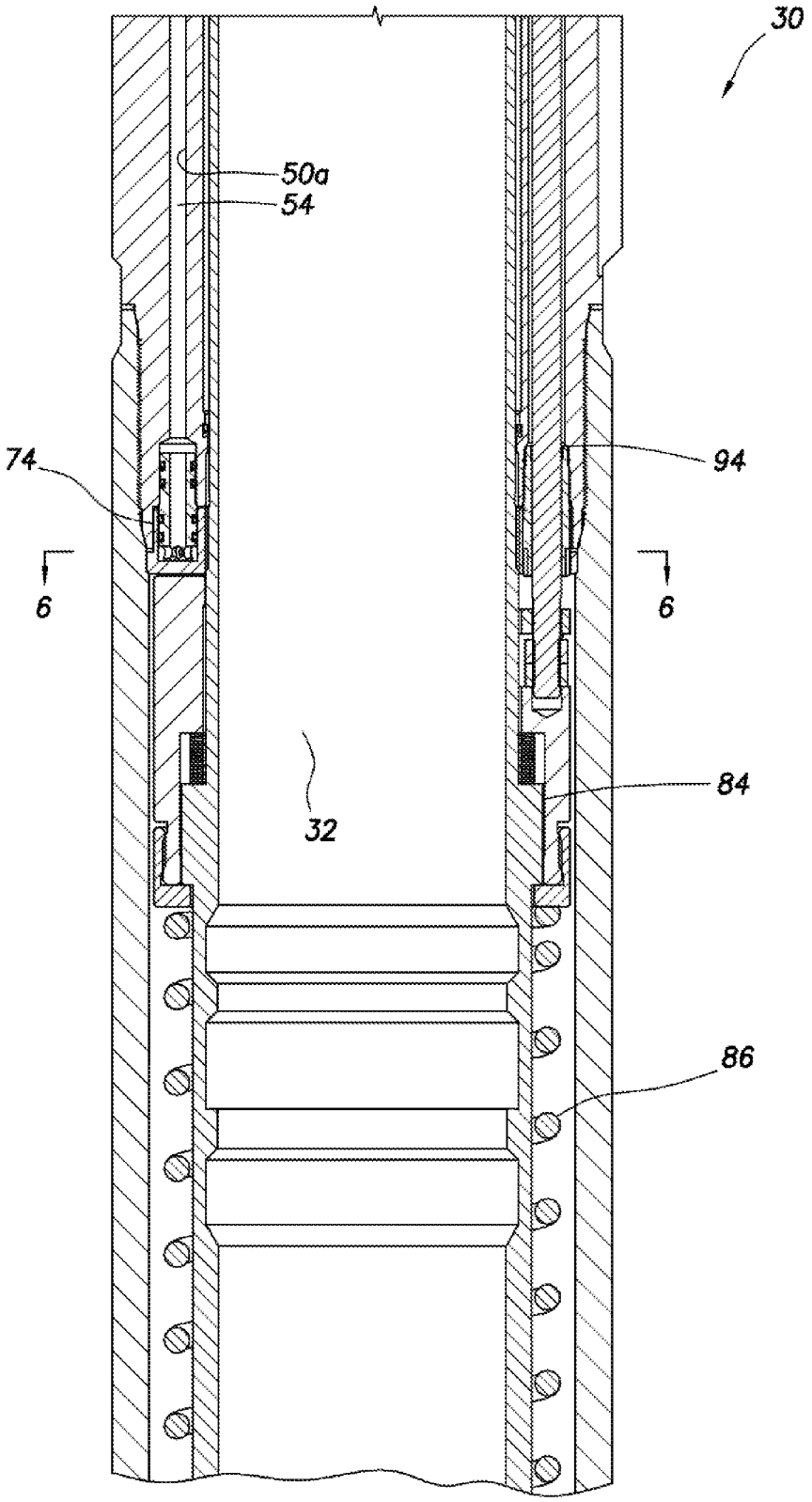

For example, as depicted in FIG. 2A, the lines 40 can extend through the upper manifold 72 to a bulkhead connector 76 in the chamber 60. The connector 76 isolates the chamber 60 from a conduit 78 extending external to the well tool 30. The conduit 78 (and the lines 40 therein) could extend to, for example, another well tool (such as, another safety valve, the telemetry device 48, etc.), a remote location, the control system 42, etc.

In other examples, the bulkhead connector 76 may not be used, and the conduit 78 can be in fluid communication with the flow path 50 and chambers 60, 62, 64, 66. In this manner, the dielectric fluid 54 (or another fluid, such as, a chemical treatment fluid, etc.) could be injected into the flow path 50 and chambers 60, 62, 64, 66 from a remote location via the conduit 78.

For example, after installation of the well tool 30 in a well, dielectric fluid 54 could be pumped through the conduit 78 from the remote location to the flow path 50 and chambers 60, 62, 64, 66. Sufficient pressure could be applied to cause the pressure relief device 68 to open, thereby allowing the fluid to be pumped into the flow passage 32 from the flow path section 50*i*.

This would ensure that the flow path 50 and chambers 60, 62, 64, 66 are filled with the dielectric fluid 54. This can also allow a chemical treatment fluid (such as, a corrosion inhibitor, a precipitate reducer, etc.) to be pumped into the flow passage 32 via the conduit 78, flow path 50 and relief valve 68.

Various sensors can be included with the well tool 30. These sensors may be useful for monitoring well parameters, monitoring operation of the well tool, controlling the operation of the well tool, etc.

In the example of FIGS. 2A-10, a pressure and/or temperature sensor 80 is disposed in the upper manifold 72 (see FIG. 5). A position sensor 82 measures a position of an operating member 84 (see FIGS. 2B-D), which is displaced by the actuator 38 against a biasing force exerted by a biasing device 86, to thereby open or close the closure member 34.

Magnets 104 are carried on the shaft 90. A position of the magnets 104 is sensed by the position sensor 82, thereby providing a measurement of the position of the operating member 84.

Note that the position sensor 82 is not necessarily a magnetic-type position sensor. The position sensor 82 could instead be a linear variable displacement transducer, acoustic rangefinder, optical sensor, or any other type of position sensor.

A force sensor 88 (see FIG. 3A) measures a force output by the actuator 38. As mentioned above, the actuator 38 in this example comprises a stepper motor. A torque output, current draw, number of step pulses, and/or any other parameter may be measured by the sensor 88, another sensor or any combination of sensors.

The motor (via suitable gearing, clutch, brake, etc., not visible in FIGS. 3A & B) displaces a shaft 90 upward or downward (as viewed in the drawings). A sealing rod piston 92 is displaced with the shaft 90. The sealing rod piston 92 isolates the dielectric fluid 54 in the chamber 62 from the well fluid 20 in the flow passage 32.

Note that, since the chamber 62 and the flow passage 32 are at substantially the same pressure, seals 96 on the piston 92 do not have to seal against a large pressure differential. Nevertheless, in this example, metal-to-metal sealing surfaces 94 are provided at each end of the piston's displacement for further sealing enhancement.

Figure 11A:
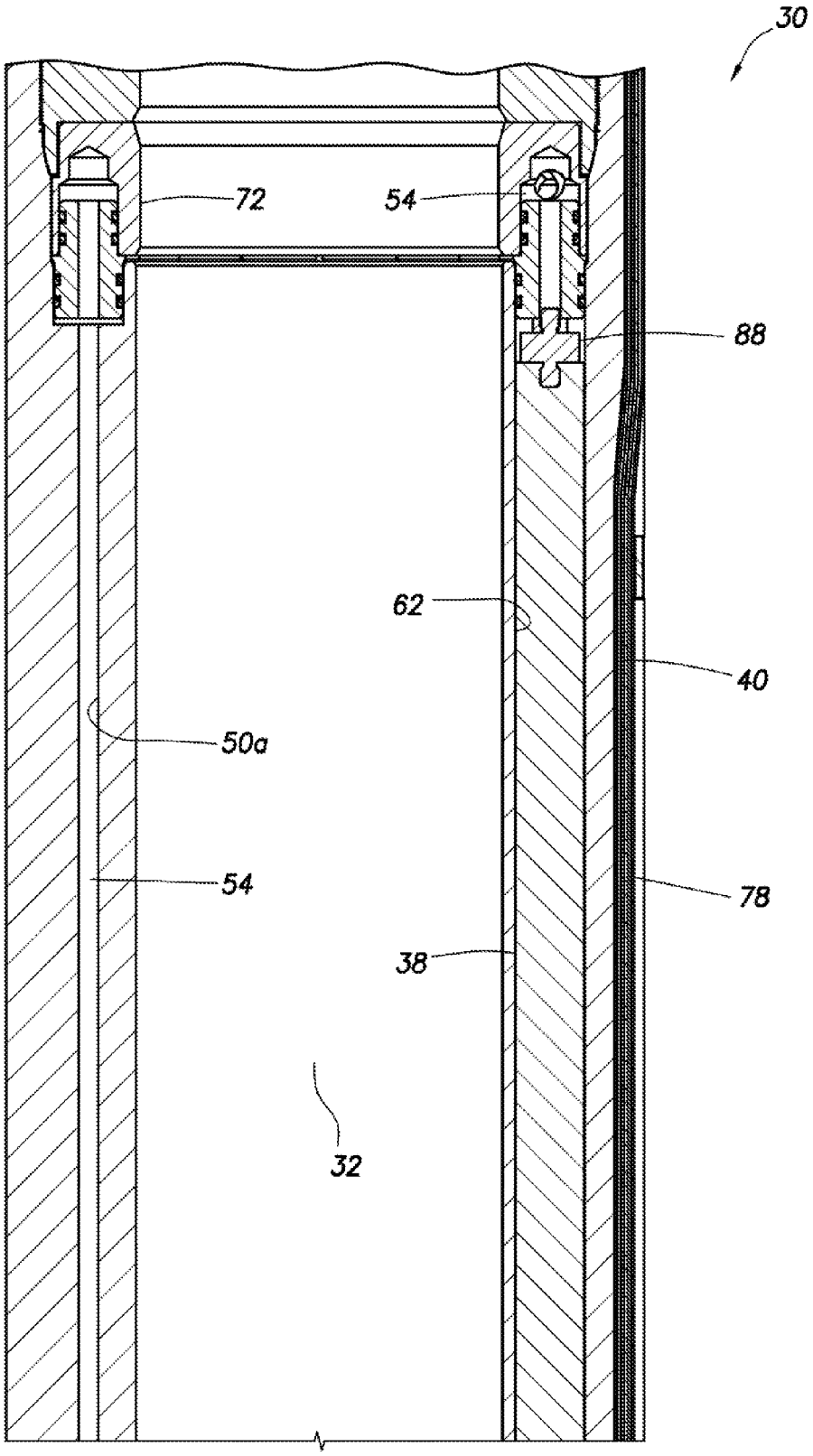
FIGS. 11A-C are representative cross-sectional views of another example of the well tool.
Figure 11B:
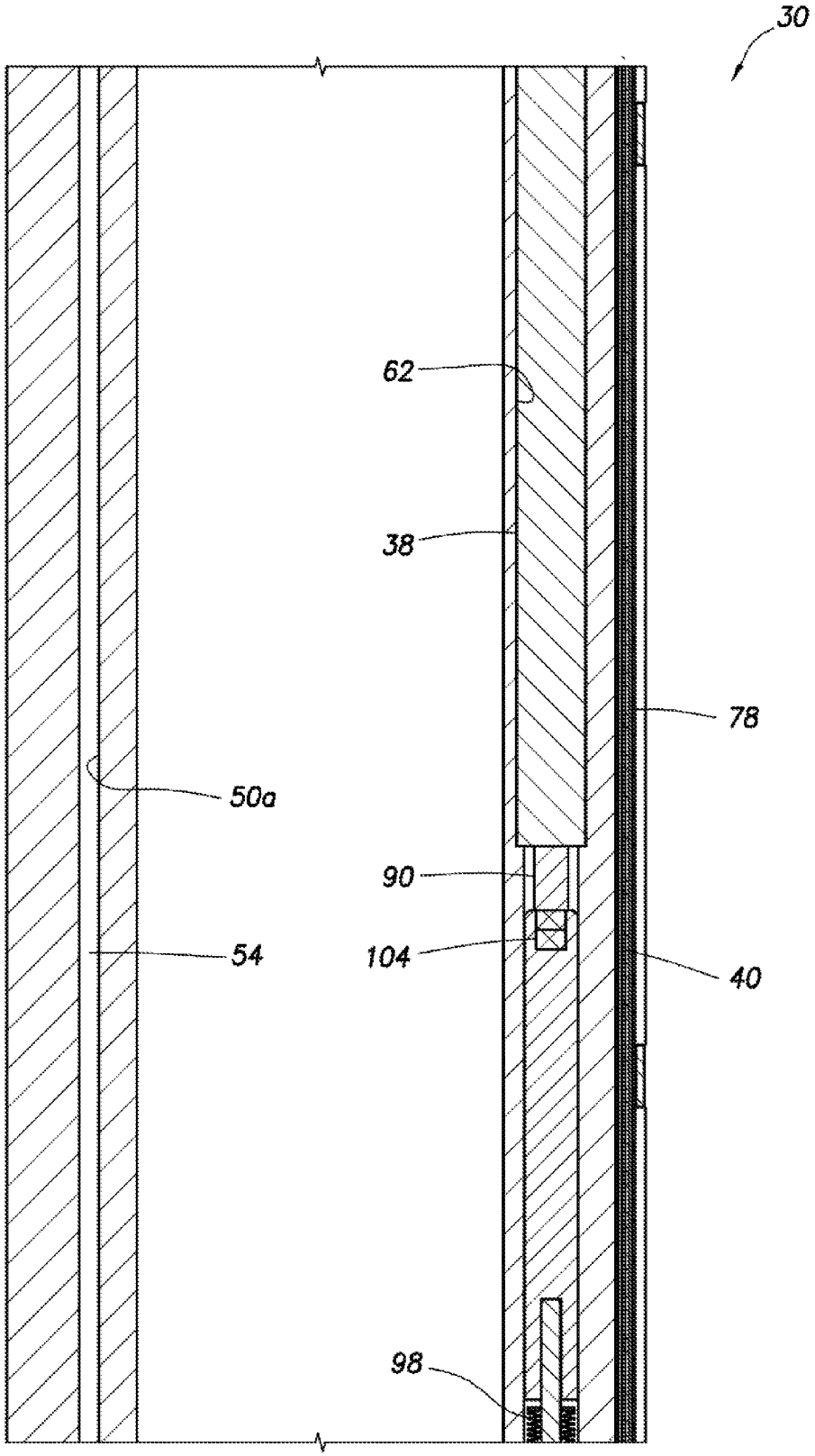
Figure 11C:
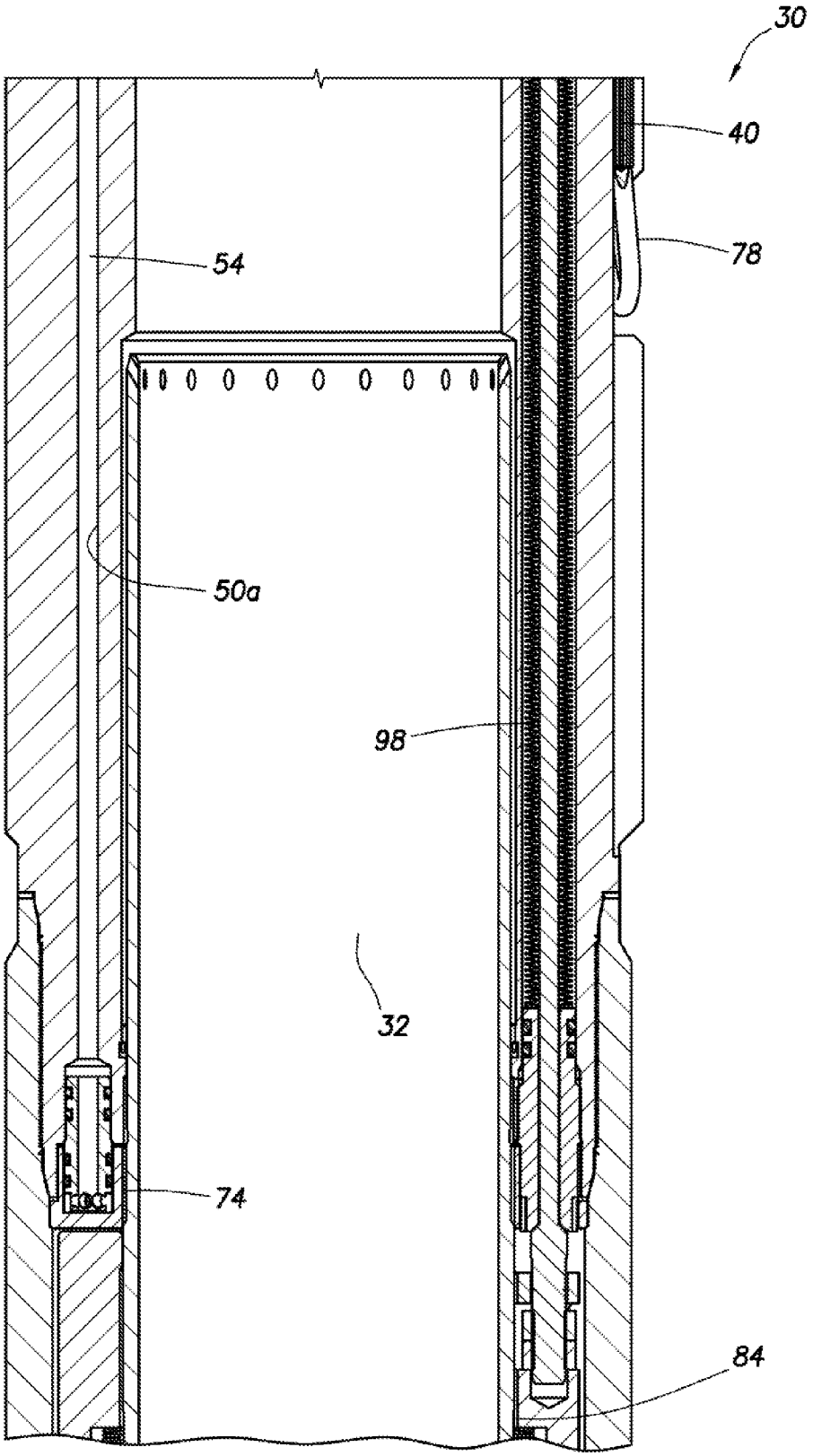

An alternative pressure transmission device could be a bellows 98, as depicted in the example of FIGS. 11A-C. Yet another alternative could be a diaphragm or membrane. Any type of pressure transmission device which can isolate the chamber 62 from the flow passage 32, while transmitting force from the actuator 38 to the operating member 84 may be used.

The operating member 84 can be displaced to any position by the actuator 38 at any time. For example, the operating member 84 can be displaced to a position in which the closure member 34 is fully closed, a position in which the closure member is fully open, a position in which an equalizing valve 100 (see FIG. 2D) is opened, etc.

When actuating the well tool 30 from its open to its closed configuration, the actuator 38 can displace the operating member 84 to its equalizing position (thereby opening the equalizing valve 100), stop at the equalizing position (e.g., using a brake of the actuator) and then continue to the open position (in which the closure member 34 is fully open). The operating member 84 can remain stopped at the equalizing position until the sensor 80 indicates that pressure in the flow passage 32 above the closure member 34 has ceased increasing, until a certain time period has elapsed, until a differential pressure sensor (not shown) indicates that pressure across the closure member 34 has equalized, etc.

Measurements made by the sensor 88 can also be used to control operation of the well tool 30. For example, the force and/or torque output by the actuator 38 could be limited to a predetermined maximum level. In some examples, this predetermined maximum level could be changed, if desired, via the control system 42.

In other examples, the force and/or torque, current draw, etc., of the actuator 38 can be optimized for most efficient and/or effective operation of the well tool 30. For example, the force output by the actuator 38 could be limited when displacing the operating member 84 from the closed position to the equalizing position, then increased to a greater level when the operating member begins opening the closure member 34, and then reduced after the closure member has been rotated a sufficient amount. If greater force is needed to displace the operating member 84 in any of these situations (or in any other situations), an alert, alarm, etc. may be provided to an operator by the control system 42 (e.g., via the display 46).

It may now be fully appreciated that significant improvements are provided to the arts by the principles set forth in this disclosure. In an example described above, electrical connections (e.g., the bulkhead connector 76, connections at the position sensor 82, sensor 88, actuator 38, etc.), a downhole electronics housing 70 weldment, a position sensor 82 and an electrical actuator 38 are installed inside of dielectric fluid 54 filled chambers 60, 62, 64, 66. All of the dielectric fluid 54 filled chambers 60, 62, 64, 66 are pressure balanced to the flow passage 32 using a flow path 50 which alternates direction multiple times.

The illustrated configuration contains only one electric actuator, one downhole electronics housing weldment, and one position sensor. However, any number of these elements may be used, as desired.

There are seven alternating dielectric fluid filled gravity assisted "U" flow path sections (fourteen total sections) to separate the production fluid from the dielectric fluid, in the illustrated configuration. However, any number of flow path sections may be used, as desired.

The passageway ports that are used for the passage of the dielectric fluid balance pressure can also be used to route electrical conductors or other types of lines from chamber to chamber. These ports can be sealed with static double o-ring seals (which always have substantially no differential pressure across them).

If desired, these ports could be laser welded instead of being sealed with o-rings. However the pressure balance device in other examples could include a chamber where the dielectric fluid is separated from the well fluids by bellows or other types of seals.

No large magnetic coupling is used in the illustrated configuration. However, a magnetic coupling could be used, in keeping with the principles of this disclosure.

Typically, the main limitation on safety valve dimensions is the wall thickness needed for the actuator. The required wall thickness can be much smaller with the illustrated design, since the electric actuator can be smaller than conventional designs.

The electric actuator for the illustrated configuration does not have to be as powerful or as large as conventional electrical safety valve actuators. The actuator in the illustrated configuration must only be strong enough to overcome the force of the biasing device 86 and friction. Since there is no differential pressure on any seals, the friction should be minimal.

A conventional rod piston 92 with leak-proof seals 96 is used in the depicted safety valve example. Note that multiple rod piston seals (or even a bellows, diaphragm, etc.) could be used in place of the leak-proof seals, since there is preferably substantially no differential pressure across the seals.

Again, all of the seals in the design will preferably have little to no pressure differential across them. No pressure differential should equate to very little to no leakage past the seals for long periods of time.

A hybrid electronics package design that is long with a small OD is used in the depicted safety valve example. This hybrid circuit design provides a significant size reduction. Longevity at high temperatures is also increased.

In other examples, a hybrid circuit that holds high pressure and, therefore, does not need a high pressure housing may be used. This can further reduce the cost of constructing the well tool.

In the depicted example, there is no welding required on any body components which experience significant tension in operation. This enhances the structural integrity of the well tool, while also reducing costs.

The tubing pressure balancing feature is integrated into the depicted safety valve example. This can also result in substantial cost reductions. However, in other examples, the tubing pressure balancing feature could be provided by a separate component that is connected to the dielectric fluid filled chambers.

The illustrated safety valve example also provides for addition of a downhole electronic pressure and/or temperature gauge as part of the safety valve. Such a pressure/temperature gauge can be installed into one of the pressure balancing chambers which are maintained at the pressure in the flow passage. This downhole gauge could transmit pressure and temperature information to a remote location on a same line as is used to control operation of the safety valve.

Complete system redundancy can be provided in at least three ways, due at least in part to the reduced cost of the safety valve example described above:

a. Multiple safety valves could be installed. A secondary valve could be pinned or temporarily locked in an open position. The secondary valve could be actuated (e.g., via a wireline trip) when a primary safety valve fails.

b. Multiple safety valves could be operated all the time. If any one safety valve fails, it can be locked open.

c. A safety valve could include multiple actuators, multiple control lines, and multiple sets of electronics. In the illustrated configuration, the number of alternating flow paths may be reduced, if the multiple actuators, etc. are to fit in the same size wall of the safety valve. If dielectric fluid contamination is a concern, more "U" tubes could be added, or a metal bellows pressure balancing system could be used instead, etc.

The illustrated configuration uses a currently new Honeywell changing magnetic field sensing position sensor. As a small magnet assembly carried by the shaft 90 moves, the Honeywell position sensor accurately reports the position. This solid state sensor has no moving parts inside the pressure housing and it should be much more reliable than a potentiometer type sensor. However, a potentiometer or other type of position sensor may be used, if desired.

There might be concerns that well fluids could eventually reach the actuation chamber if the flow path is open to the flow passage (e.g., if the floating piston assembly 56 is not used). However, the multiple alternating direction flow path sections 50*a-n* should be effective to prevent migration of the well fluid 20 into the chambers 60, 62, 64, 66.

The floating piston assembly 56 forms a physical barrier between the well fluids and the dielectric fluid, thereby preventing mixing of the fluids. The floating piston could move inward and outward with changes in pressure, but its inward movement could be limited by the compressibility of the dielectric fluid, and its outward movement could be limited by the expansiveness of the dielectric fluid.

A basic combination described above is a chamber filled with a dielectric fluid, with one end of a flow path connected to the chamber, and another end of the flow path in communication with the flow passage. While this integral pressure balancing feature is primarily described for an electrically actuated safety valve, it could potentially be used with other well tools, such as sliding sleeves, chemical injection valves, separators, etc.

The depicted electric safety valve system can include an electric actuator with downhole electronic circuitry, a downhole telemetry device (transmitter and/or receiver), and a control system at a remote location (such as, at the earth's surface, a rig, an underwater facility, etc.).

A position sensor can report the relative position of the operating member from the start (or the fully closed position) to the end (or the fully open position) to the electronic circuitry. The electronic circuitry transmits this information to the telemetry device. The telemetry device then relays the position information to the control system. In some examples, an operator at the remote location can view the position of the operating member.

The control system can display when the safety valve should be fully open, for example, after a preset number of stepper motor steps have been executed. This control system computer display indication can be independent of the position sensor, so that a failure of the position sensor does not affect the opening/closing functions of the safety valve.

The control system can display when the valve is in the closed position, when the control system's computer program is running. The safety valve will preferably automatically close if the control system is shut down, electric power to the safety valve is lost, or a computer used to run the computer program fails.

In another example, the safety valve could go into a hold state if the control system fails or is shut down, instead of the safety valve automatically closing. The reason for the failure or shutdown could be a system maintenance issue that does not require the well to be shut-in.

The force sensor 88 periodically reports to the control system the measured force output by the actuator. These force measurements can comprise a secondary indication of the safety valve operation, which may be used in case the position sensor 82 fails.

If the safety valve is a self-equalizing type (e.g., comprising the equalizing valve 100), the electronic circuitry or the control system can be preprogrammed to displace the operating member only to the equalizing position, and then set the brake until the operator issues a command to the control system to continue to open the safety valve to the fully open position.

The temperature, pressure, vibration, etc. of the electronic circuitry can be reported periodically to the control system. For example, this information can be displayed after the safety valve is closed. The temperature, pressure, vibration, etc. could also be displayed and/or recorded in real time.

The pressure and temperature in the tubular string 12 (e.g., as measured by the sensor 80) may be reported periodically to the control system 42 (e.g., the safety valve is open), or after the valve is closed, and/or in real time. This can be accomplished with an integral downhole pressure/temperature gauge or other dedicated sensors.

If the force on the actuator or the force required to open the flapper exceeds a preset limit, indicating that pressure across the flapper is not equalized, the electronic circuitry can automatically command the safety valve to close (e.g., causing the actuator to reverse direction), and the force overload can be reported to the control system.

The operator can then set this force limit to a higher level, if desired. However, the stepper motor will likely dither and not open the safety valve if the maximum motor torque is reached. In this circumstance, the operator can increase the tubing pressure to equalize the pressure above the flapper to the pressure below the flapper.

The current and voltage supplied to the clutch, brake, and stepper motor are preferably reported periodically to the control system.

The torque output of the stepper motor can be increased by decreasing a frequency of electrical step pulses transmitted to the motor. The time to open the safety valve can be optimized by increasing the frequency of the pulses at the beginning of the displacement when the force output by the biasing device is lowest, and decreasing the frequency at the end of the displacement when the spring force is highest.

This functionality can be enhanced by monitoring the force sensor output. If the force sensor indicates an increased force, the frequency of the step pulses can be reduced.

In order to optimize electrical power usage, the safety valve can have a demand system, whereby the power is continuously monitored, and is maintained within a narrow range. The safety valve will likely have an optimum power at which it performs its function. This optimum power is sufficient to operate the valve, with a minimum amount of excess power. In this manner, smaller electrical components can be used and less heat is generated in the downhole electronic circuitry, actuator, etc.

In one example, if the flow passage 32 pressure is below or above a preset limit, the valve would automatically close. A warning with a predetermined override time limit could be displayed by the control system 42 before this happens, so the valve would not be closed unless circumstances warrant.

This would allow the operator to override the closure if the downhole pressure gauge failed or the pressure limits are incorrect. The pressure limits could be reset at the control system 42. If the override command is not received during the given time period, the valve could automatically close.

The control system 42 could automatically alternate redundant clutches and/or brakes of the actuator 38.

Note that the electric actuator 38 and other components used in the illustrated configuration could also be used to operate a downhole choke, sliding sleeve valve, etc., instead of a subsurface safety valve. For a downhole choke, other sensors such as resistivity and a differential pressure flow meter could be included in the design, so that operation of the choke could be controlled, based on the outputs of such sensors.

The electronic circuitry and/or telemetry device may be reprogrammed from the control system 42.

Another self-equalizing function can be included as part of the safety valve. The operating member 84 can be displaced from the closed position to a predetermined equalizing position, at which the equalizing valve 100 opens. The brake would be set, holding the operating member 84 in the equalizing position. The pressure gauge could be monitored, until the pressure above the closure member 34 stops increasing for a predetermined time period, then the operating member 84 would be displaced to the open position.

A well tool 30 for use with a subterranean well is described above. In one example, the well tool 30 can include a flow passage 32 extending longitudinally through the well tool 30, an internal chamber 60, 62, 64, 66 containing a dielectric fluid 54, and a flow path 50 which alternates direction, and which provides pressure communication between the internal chamber 60, 62, 64, 66 and the flow passage 32.

The well tool 30 can also include a floating piston 102 in the flow path 50. The floating piston 102 may prevent the dielectric fluid 54 from flowing into the flow passage 32. The floating piston 102 can be positioned in an enlarged section 50*o* of the flow path 50.

The well tool 30 may include an electrical actuator 38 in the dielectric fluid 54. The actuator 38 can displace a pressure transmission device (e.g., piston 92, bellows 98, etc.) which isolates the chamber 60, 62, 64, 66 from the flow passage 32. The pressure transmission device may comprises a bellows 98 and/or a piston 92.

The chamber 60, 62, 64, 66 can be in fluid communication with a source of the dielectric fluid 54 via a conduit 78 extending to a remote location. A line 40 may extend through the conduit 78 to an actuator 38 in the chamber 62.

The chamber 60, 62, 64, 66 can be in fluid communication with a source of chemical treatment fluid via a conduit 78 extending to a remote location. In this example also, a line 40 may extend through the conduit 78 to an actuator 38 in the chamber 62.

The well tool 30 can include a pressure relief device 68. The pressure relief device 68 may permit the dielectric fluid 54 to flow into the flow passage 32 in response to pressure in the chamber 60, 62, 64, 66 exceeding a predetermined pressure level.

The well tool 30 can include an actuator 38 in the dielectric fluid 54, and a force sensor 88 which senses a force applied by the actuator 38. The force applied by the actuator 38 may be controlled, based on measurements made by the force sensor 88.

The force output by the actuator 38 can vary, based on a displacement of an operating member 84 of the well tool 30 by the actuator 38. The well tool 30 can include a displacement or position sensor 82 which senses the displacement of the operating member 84.

The displacement of the operating member 84 may cause displacement of a closure member 34 which selectively permits and prevents flow through the flow passage 32. The displacement of the operating member 84 can actuate an equalizing valve 100 which equalizes pressure across the closure member 34.

The well tool 30 can include at least one of the group comprising temperature, force, pressure, position, and vibration sensors in the dielectric fluid 54. At least one of the sensors (e.g., vibration sensor 106, see FIG. 8B) and an electronic circuit 36 may be disposed in an enclosure 71 isolated from pressure in the chamber 66.

A method of controlling operation of a well tool 30 is also described above. In one example, the method can include actuating an actuator 38 positioned in an internal chamber 62 of the well tool 30, a dielectric fluid 54 being disposed in the chamber 62, and the chamber 62 being pressure balanced with a flow passage 32 extending longitudinally through the well tool 30; and varying the actuating, based on measurements made by at least one sensor 80, 82, 88, 106 of the well tool 30.

The actuating step can also include displacing an operating member 84. The sensor 82 may sense displacement of the operating member 84. The varying step can include changing a speed of the displacement, based on the sensed displacement of the operating member 84.

The varying step can include changing a force and/or torque output by the actuator 38, based on the sensed displacement of the operating member 84.

The varying step can include varying a frequency of electrical pulses transmitted to the actuator 38.

The varying step can include closing a closure member 34, in response to the sensor 88 sensing that a force output by the actuator 38 exceeds a predetermined maximum force level.

The varying step can include ceasing displacement of an operating member 84, and then resuming displacement of the operating member 84. The ceasing displacement step may be performed when the actuator 38 has displaced the operating member 84 to an equalizing position, in which pressure is equalized across a closure member 34. The resuming displacement step may be performed when the pressure has equalized across the closure member 34, and/or in response to a predetermined period of time elapsing from the operating member 84 being displaced to the equalizing position.

The well tool 30 may comprise a safety valve. The actuator 38 may cause a closure member 34 to be alternately opened and closed to thereby respectively permit and prevent flow through the flow passage 32.

In particular, the above disclosure describes a safety valve 30 for use in a subterranean well. In one example, the safety valve 30 can include a flow passage 32 extending longitudinally through the safety valve 30, an internal chamber 60, 62, 64, 66 containing a dielectric fluid 54, a flow path 50 which alternates direction, and which provides pressure communication between the internal chamber 60, 62, 64, 66 and the flow passage 32, an actuator 38 exposed to the dielectric fluid 54, an operating member 84, and a closure member 34 having open and closed positions, in which the closure member 34 respectively permits and prevents flow through the flow passage 32. The actuator 38 can displace the operating member 84, which causes displacement of the closure member 34 between its open and closed positions.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A well tool for use with a subterranean well, the well tool comprising:

a flow passage extending longitudinally through the well tool;

an internal chamber containing a dielectric fluid;

a flow path which provides pressure communication between the internal chamber and the flow passage, and which includes at least two reversals in flow direction, thereby preventing migration of well fluid into the internal chamber, wherein the flow path comprises multiple flow path sections that extend longitudinally from an upper manifold to a lower manifold, wherein alternating opposite ends of adjacent flow path sections are placed in fluid communication with each other by the upper and lower manifolds, and wherein each of the upper and lower manifolds is connected to at least three flow path sections; and an electrical actuator in the dielectric fluid, wherein the actuator displaces a pressure transmission device which isolates the chamber from the flow passage.

2. The well tool of claim 1, wherein the pressure transmission device comprises a bellows.

3. The well tool of claim 1, wherein the pressure transmission device comprises a piston.

4. A well tool for use with a subterranean well, the well tool comprising:

a flow passage extending longitudinally through the well tool;

an internal chamber containing a dielectric fluid; and a flow path which alternates direction, and which provides pressure communication between the internal chamber and the flow passage, wherein the chamber is in fluid communication with a source of chemical treatment fluid via a conduit extending to a remote location, and wherein an electrical line extends through the conduit and supplies electrical power to an actuator in the chamber.

5. A well tool for use with a subterranean well, the well tool comprising:

a flow passage extending longitudinally through the well tool;

an internal chamber containing a dielectric fluid;

a flow path which provides pressure communication between the internal chamber and the flow passage, and which includes at least two reversals in flow direction, thereby preventing migration of well fluid into the internal chamber, wherein the flow path comprises multiple flow path sections that extend longitudinally from an upper manifold to a lower manifold, wherein alternating opposite ends of adjacent flow path sections are placed in fluid communication with each other by the upper and lower manifolds, and wherein each of the upper and lower manifolds is connected to at least three flow path sections; and an actuator in the dielectric fluid, wherein a force output by the actuator varies, based on a displacement of an operating member of the well tool by the actuator.

6. The well tool of claim 5, further comprising a displacement sensor which senses the displacement of the operating member.

7. The well tool of claim 5, wherein the displacement of the operating member causes displacement of a closure member which selectively permits and prevents flow through the flow passage.

8. The well tool of claim 5, wherein the displacement of the operating member actuates an equalizing valve which equalizes pressure across the closure member.

9. A safety valve for use in a subterranean well, the safety valve comprising:

a flow passage extending longitudinally through the safety valve;

an internal chamber containing a dielectric fluid;

a flow path which provides pressure communication between the internal chamber and the flow passage, and which includes at least two reversals in flow direction, thereby preventing migration of well fluid into the internal chamber, wherein the flow path comprises multiple flow path sections that extend longitudinally from an upper manifold to a lower manifold, wherein alternating opposite ends of adjacent flow path sections are placed in fluid communication with each other by the upper and lower manifolds, and wherein each of the upper and lower manifolds is connected to at least three flow path sections;

an actuator exposed to the dielectric fluid;

an operating member; and a closure member having open and closed positions, wherein the closure member respectively permits and prevents flow through the flow passage, wherein the actuator displaces the operating member, which causes displacement of the closure member between the open and closed positions, and wherein the actuator displaces a pressure transmission device which isolates the chamber from the flow passage.

10. The safety valve of claim 9, wherein the pressure transmission device comprises a bellows.

11. The safety valve of claim 9, wherein the pressure transmission device comprises a piston.

12. A safety valve for use in a subterranean well, the safety valve comprising:

a flow passage extending longitudinally through the safety valve;

an internal chamber containing a dielectric fluid;

a flow path which alternates direction, and which provides pressure communication between the internal chamber and the flow passage;

an actuator exposed to the dielectric fluid;

an operating member; and a closure member having open and closed positions, wherein the closure member blocks flow through the flow passage when the closure member is in the closed position, wherein the actuator displaces the operating member, which causes displacement of the closure member between the open and closed positions, wherein the chamber is in fluid communication with a source of the dielectric fluid via a conduit extending to a remote location, and wherein a line extends through the conduit to the actuator.

13. A safety valve for use in a subterranean well, the safety valve comprising:

a flow passage extending longitudinally through the safety valve;

an internal chamber containing a dielectric fluid;

a flow path which alternates direction, and which provides pressure communication between the internal chamber and the flow passage;

an actuator exposed to the dielectric fluid;

an operating member; and a closure member having open and closed positions, wherein the closure member respectively permits and prevents flow through the flow passage, wherein the actuator displaces the operating member, which causes displacement of the closure member between the open and closed positions, wherein the chamber is in fluid communication with a source of chemical treatment fluid via a conduit extending to a remote location, and wherein a line extends through the conduit to the actuator.

14. A safety valve for use in a subterranean well, the safety valve comprising:

a flow passage extending longitudinally through the safety valve;

an internal chamber containing a dielectric fluid;

a flow path which provides pressure communication between the internal chamber and the flow passage, and which includes at least two reversals in flow direction, wherein the flow path comprises multiple flow path sections that extend longitudinally from an upper manifold to a lower manifold, wherein alternating opposite ends of adjacent flow path sections are placed in fluid communication with each other by the upper and lower manifolds, and wherein each of the upper and lower manifolds is connected to at least three flow path sections;

an actuator exposed to the dielectric fluid;

an operating member;

a closure member having open and closed positions, wherein the closure member blocks flow through the flow passage when the closure member is in the closed position, and wherein the actuator displaces the operating member, which causes displacement of the closure member between the open and closed positions; and a pressure relief device, wherein the pressure relief device permits the dielectric fluid to flow into the flow passage in response to pressure in the chamber exceeding a predetermined pressure level.

15. A safety valve for use in a subterranean well, the safety valve comprising:

a flow passage extending longitudinally through the safety valve;

an internal chamber containing a dielectric fluid;

a flow path which provides pressure communication between the internal chamber and the flow passage, and which includes at least two reversals in flow direction, wherein the flow path comprises multiple flow path sections that extend longitudinally from an upper manifold to a lower manifold, wherein alternating opposite ends of adjacent flow path sections are placed in fluid communication with each other by the upper and lower manifolds, and wherein each of the upper and lower manifolds is connected to at least three flow path sections;

an actuator exposed to the dielectric fluid;

an operating member;

a closure member having open and closed positions, wherein the closure member blocks flow through the flow passage when the closure member is in the closed position, and wherein the actuator displaces the operating member, which causes displacement of the closure member between the open and closed positions; and a force sensor which senses a force applied by the actuator.

16. The safety valve of claim 15, wherein the force applied by the actuator is controlled, based on measurements made by the force sensor.

17. A safety valve for use in a subterranean well, the safety valve comprising:

a flow passage extending longitudinally through the safety valve;

an internal chamber containing a dielectric fluid;

a flow path which provides pressure communication between the internal chamber and the flow passage, and which includes at least two reversals in flow direction, wherein the flow path comprises multiple flow path sections that extend longitudinally from an upper manifold to a lower manifold, wherein alternating opposite ends of adjacent flow path sections are placed in fluid communication with each other by the upper and lower manifolds, and wherein each of the upper and lower manifolds is connected to at least three flow path sections;

an actuator exposed to the dielectric fluid;

an operating member; and a closure member having open and closed positions, wherein the closure member blocks the flow passage when the closure member is in the closed position, wherein the actuator displaces the operating member, which causes displacement of the closure member between the open and closed positions, and wherein a force output by the actuator varies, based on a displacement of the operating member by the actuator.

18. The safety valve of claim 17, further comprising a displacement sensor which senses the displacement of the operating member.

19. The safety valve of claim 17, wherein the displacement of the operating member actuates an equalizing valve which equalizes pressure across the closure member.

* * * * *